US010939752B2

(12) United States Patent
Moore

(10) Patent No.: US 10,939,752 B2
(45) Date of Patent: Mar. 9, 2021

(54) VARIABLE HEIGHT DESK

(71) Applicant: URBAN PLOUGH LLC, Phoenix, AZ (US)

(72) Inventor: Matthew Moore, Phoenix, AZ (US)

(73) Assignee: URBAN PLOUGH LLC, Phoenix, AZ (US)

( * ) Notice: Subject to any disclaimer, the term of this patent is extended or adjusted under 35 U.S.C. 154(b) by 61 days.

(21) Appl. No.: 16/256,916

(22) Filed: Jan. 24, 2019

(65) Prior Publication Data

US 2019/0223590 A1 Jul. 25, 2019

Related U.S. Application Data

(60) Provisional application No. 62/621,989, filed on Jan. 25, 2018.

(51) Int. Cl.

| | |
|---|---|
| ***A47B 21/02*** | (2006.01) |
| ***A47B 9/00*** | (2006.01) |
| ***A47B 87/00*** | (2006.01) |
| ***A47B 21/06*** | (2006.01) |
| ***A47B 83/00*** | (2006.01) |

(52) U.S. Cl.

CPC ..... *A47B 21/02* (2013.01); *A47B 9/00* (2013.01); *A47B 21/06* (2013.01); *A47B 83/001* (2013.01); *A47B 87/002* (2013.01); *A47B 2021/066* (2013.01); *A47B 2200/0075* (2013.01); *A47B 2200/12* (2013.01)

(58) Field of Classification Search

CPC ..... A47B 2200/004; A47B 2200/0066; A47B 2200/0075; A47B 2200/12; A47B 9/06; A47B 9/00; A47B 83/001; A47B 87/002; A47B 2021/006; A47B 21/02; A47B 21/06; A47B 57/30; E04B 2002/7483; E04B 2/7416

USPC ..... 312/306, 312, 319.5–319.8, 194–196, 312/223.3; 108/146, 147, 50.01, 50.02, 108/20, 27; 52/36.1, 36.4, 36.5

See application file for complete search history.

(56) References Cited

U.S. PATENT DOCUMENTS

| | | | | |
|---|---|---|---|---|
| D164,584 | S | 9/1951 | Koegel | |
| 2,636,224 | A * | 4/1953 | Murdoch | E04B 2/7437 52/36.1 |
| 3,113,531 | A | 12/1963 | Barnard | |
| D208,256 | S | 8/1967 | Rich | |
| D243,192 | S | 1/1977 | Abrahamsen | |
| D243,300 | S | 2/1977 | Christensen | |
| D261,713 | S | 11/1981 | Curatolo | |
| D262,763 | S | 1/1982 | Lerner | |
| D262,846 | S | 2/1982 | Chaiken | |

(Continued)

FOREIGN PATENT DOCUMENTS

| | | |
|---|---|---|
| CA | 2348060 | * 11/2002 |
| CA | 2840843 | * 12/2013 |

(Continued)

*Primary Examiner* — Janet M Wilkens

(74) *Attorney, Agent, or Firm* — Lewis Roca Rothgerber Christie LLP

(57) ABSTRACT

A variable height desk includes: a main support; a plurality of linear guides mounted to the main support; a desk mounting panel mounted to and configured to move along the linear guides; a desk surface mounted to the desk mounting panel; and an actuator accommodated in the main support and configured to raise and lower the desk mounting panel.

18 Claims, 31 Drawing Sheets

(56) References Cited

U.S. PATENT DOCUMENTS

| | | | | |
|---|---|---|---|---|
| D278,583 | S | 4/1985 | Koguma | |
| D285,394 | S | 9/1986 | Curran | |
| 4,651,652 | A * | 3/1987 | Wyckoff | A47B 9/12 108/147 |
| 4,790,611 | A * | 12/1988 | Craner | A47B 57/00 108/147 |
| D305,585 | S | 1/1990 | Wright | |
| 4,969,403 | A * | 11/1990 | Schwartz | A47B 5/00 108/147 |
| 4,987,835 | A * | 1/1991 | Schwartz | A47B 57/30 108/147 |
| 5,083,514 | A * | 1/1992 | Schwartz | A47B 5/00 108/108 |
| D330,469 | S | 10/1992 | Brodbeck | |
| D345,062 | S | 3/1994 | Brandon | |
| 5,544,593 | A | 8/1996 | Canfield | |
| 5,720,185 | A | 2/1998 | Lee | |
| 6,070,956 | A | 6/2000 | Yates | |
| D441,566 | S | 5/2001 | Martin | |
| 6,708,627 | B1 | 3/2004 | Wood | |
| D496,183 | S | 9/2004 | Savage | |
| D546,103 | S | 7/2007 | Eyman | |
| D552,900 | S | 10/2007 | Wilenius | |
| 7,331,296 | B1 | 2/2008 | Wood | |
| D596,876 | S | 7/2009 | Oshinomi | |
| D610,840 | S | 3/2010 | Kato | |
| 7,866,622 | B2 * | 1/2011 | Dittmer | F16M 11/10 248/421 |
| D647,324 | S | 10/2011 | Kincaid | |
| D653,862 | S | 2/2012 | Hairston | |
| D677,943 | S | 3/2013 | Mendoza | |
| D724,364 | S | 3/2015 | Demars | |
| 8,985,032 | B1 | 3/2015 | Johnson | |
| D730,658 | S | 6/2015 | Dillon | |
| 9,277,806 | B2 * | 3/2016 | Hallman | A61G 13/0027 |
| D761,577 | S | 7/2016 | Agati | |
| D773,219 | S | 12/2016 | Clouse | |
| 9,593,481 | B2 | 3/2017 | Gosling | |
| D788,496 | S | 6/2017 | Yamamoto | |
| 9,723,919 | B1 * | 8/2017 | Randolph | A47B 21/04 |
| 9,980,559 | B2 | 5/2018 | Randolph | |
| 10,034,538 | B1 * | 7/2018 | Masters | A47B 9/10 |
| D853,759 | S * | 7/2019 | Moore | D6/644 |
| 10,561,233 | B1 * | 2/2020 | Lin | A47B 9/12 |
| 2005/0016080 | A1 * | 1/2005 | Williams | E04B 2/7416 52/36.1 |
| 2006/0185564 | A1 | 8/2006 | Stengel | |
| 2006/0230992 | A1 | 10/2006 | Newhouse | |
| 2008/0018211 | A1 | 1/2008 | Dye | |
| 2008/0284292 | A1 | 11/2008 | Castelluccio | |
| 2008/0284293 | A1 | 11/2008 | Martin | |
| 2009/0094913 | A1 | 4/2009 | Singh | |
| 2016/0128469 | A1 * | 5/2016 | Matthai | E04B 2/7416 312/265.1 |
| 2016/0353876 | A1 * | 12/2016 | Mitchell | A47B 5/00 |
| 2018/0168334 | A1 * | 6/2018 | Swartz | A47B 21/06 |

FOREIGN PATENT DOCUMENTS

| | | |
|---|---|---|
| GB | 2362822 | * 12/2001 |
| WO | 2016195853 | * 12/2016 |

* cited by examiner

VARIABLE HEIGHT DESK

CROSS-REFERENCE TO RELATED APPLICATION

This application claims priority to and the benefit of U.S. Provisional Application No. 62/621,989, filed on Jan. 25, 2018, the entire content of which is incorporated herein by reference.

BACKGROUND

1. Field

Aspects of example embodiments of the present invention relate to a variable height desk (e.g., a sit-stand desk).

2. Related Art

Recently, the health implications of sitting for extended periods of time have been studied in more detail. It has been found that extended periods of sitting may lead to an increased risk of obesity and metabolic syndrome, including increased blood pressure, high blood sugar, etc. Generally, employees spend a majority of their work day sitting at a desk. Accordingly, there has been an effort to reduce the amount of time employees spend sitting at their desks to increase employee health and productivity and reduce employer healthcare costs.

To this end, standing desks (or stand-up desks) were developed, which allow users to work while standing. Standing desks typically include a desk surface at a fixed height above the ground, which is comfortable for a user to use while standing. However, because standing desks generally have a fixed height, a single size (or height) standing desk may not be comfortable or accessible for all users, especially between men and women of different heights. Furthermore, because standing desks do not permit a user to work while sitting, the user may become fatigued or injured from standing for excessive periods of time.

To capitalize on the benefits of both sitting desks (e.g., traditional desks) and standing desks, variable height desks (or sit-stand desks) have been developed. Sit-stand desks typically include a desk surface that can be adjusted up or down to adjust a height of the desk surface above the ground. Sit-stand desks allow a user to decide if they wish to work sitting down or standing up and adjust the desk accordingly. Thus, a user may be able to alternate between sitting and standing throughout the day, allowing the user avoid sitting for excessive periods of time while also allowing the user to avoid becoming fatigued by standing for excessive periods of time.

SUMMARY

The present disclosure is directed toward various embodiments of a variable height desk.

According to one embodiment, a variable height desk includes: a main support; a plurality of linear guides mounted to the main support; a desk mounting panel mounted to and configured to move along the linear guides; a desk surface mounted to the desk mounting panel; and an actuator accommodated in the main support and configured to raise and lower the desk mounting panel.

The main support may have an L-shape.

The main support may include a longer length portion and a shorter length portion, and the actuator may be accommodated in the longer length portion of the main support.

The actuator may be a worm drive actuator.

The variable height desk may further include a privacy screen removably coupled to the desk mounting panel and extending above the desk surface.

The privacy screen may extend below the desk surface.

The privacy screen may include an extended side portion. The privacy screen and the extended side portion may together form an L-shape.

The variable height desk may further include a cover panel mounted to the main support, and the cover panel may have an opening therein exposing an end of the actuator.

The actuator may include a mounting block on the exposed end thereof.

According to another embodiment, a variable height desk includes: a main support; a plurality of linear guides mounted to the main support, a first group of the linear guides mounted to a first side of the main support, a second group of the linear guides mounted to a second side of the main support; a first desk mounting panel mounted to and configured to move along the first group of the linear guides; a second desk mounting panel mounted to and configured to move along the second group of the linear guides; a first desk surface mounted to the first desk mounting panel; a second desk surface mounted to the second desk mounting panel; and a plurality of actuators accommodated in the main support, a first one of the actuators being configured to raise and lower the first desk mounting panel, a second one of the actuators being configured to raise and lower the second desk mounting panel.

The actuators may be arranged adjacent each other along a line perpendicular to a moving direction of the actuators.

Each of the first and second desk mounting panels may have a plurality of groups of mounting openings. A first group of the mounting openings of each of the first and second desk mounting panels may be configured for connection to the first one of the actuators, and a second group of the mounting openings of each of the first and second desk mounting panels may be configured for connection to the second one of the actuators.

The first and second ones of the actuators may be configured to raise and lower the first and second desk mounting panels independently from each other.

The main support may have a T-shape.

The variable height desk may further include a privacy screen coupled between the first desk mounting surface and the first desk surface.

The privacy screen may include a privacy screen mounting rail that is configured to be coupled to an upper edge of the first desk mounting panel.

The upper edge of the first desk mounting panel may be beveled, a lower edge of the privacy screen mounting rail may be beveled, and the beveled upper edge of the first desk mounting panel and the beveled lower edge of the privacy screen mounting rail may be configured to be fitted to each other.

The privacy screen may be mounted to the first desk mounting panel by gravity.

The variable height desk may further include a plurality of linear bearings mounted to the first desk mounting panel. The linear bearings may be connected to ones of the first group of the linear guides.

The linear bearings may be track rollers.

DETAILED DESCRIPTION

Figure 1:
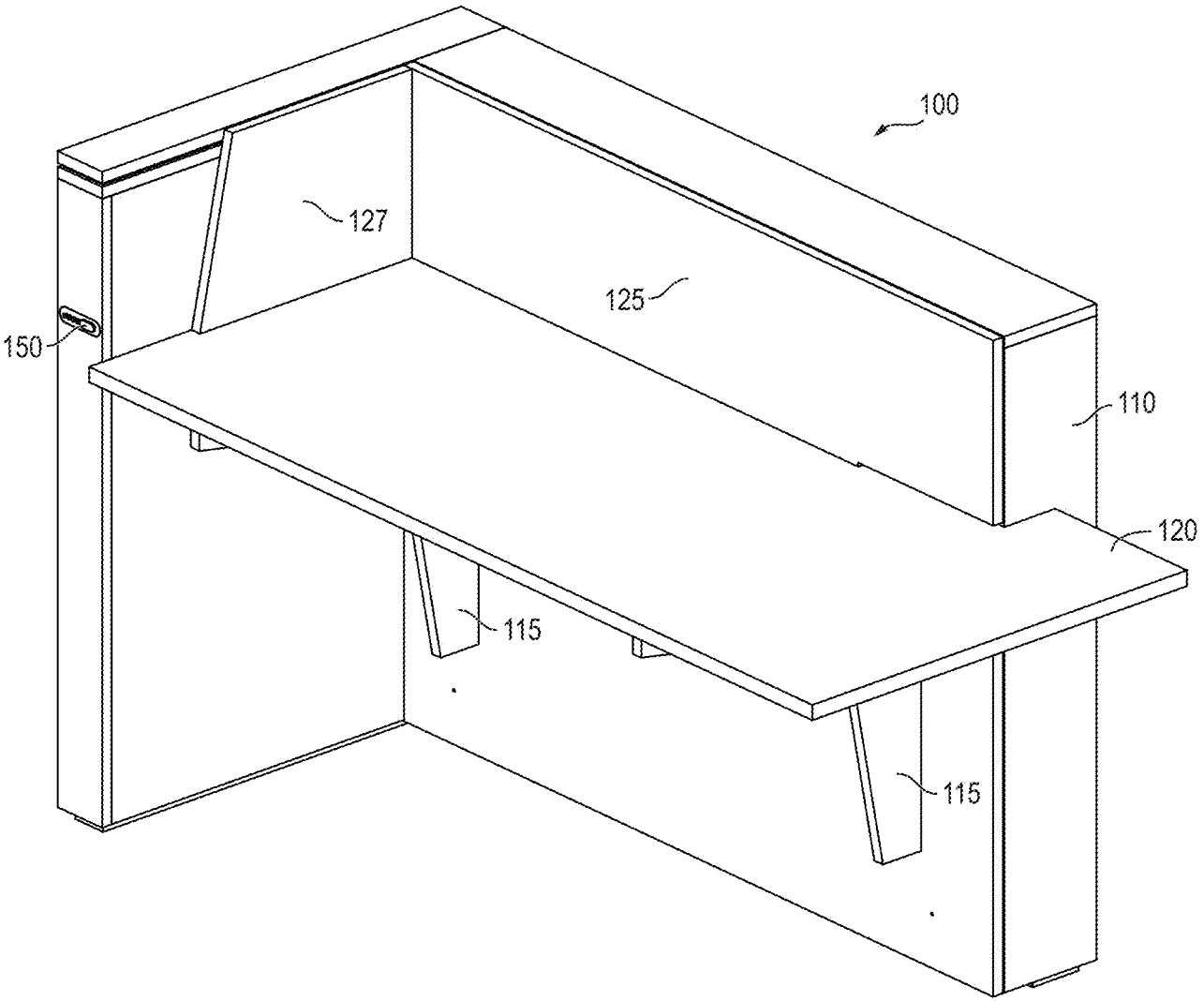
FIG. 1 is a perspective view of a first embodiment of a variable height desk in a lowered position.

The present disclosure is directed toward various example embodiments of a variable height desk that provides a relatively large desk surface that may be easily moved between lowered and raised positions by a user and may be supported at any position between the lowered and raised positions. The various example embodiments further provide a main support that sits on a floor and a privacy screen that moves along with the desk surface, ensuring the user's privacy regardless of the position of the desk surface. Thus, the variable height desk according to embodiments of the present invention may be used in professional workplaces and the like without appearing informal or incomplete while giving users privacy regardless of the position of the desk surface. Further, various embodiments provide multiple desk surfaces that share a common main support and can be independently controlled (e.g., independently raised and lowered), thus providing additional variable height desks in a reduced footprint and at a reduced cost.

Hereinafter, example embodiments of the present invention will be described, in more detail, with reference to the accompanying drawings. The present invention, however, may be embodied in various different forms, and should not be construed as being limited to only the embodiments illustrated herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section described below could be termed a second element, component, region, layer, or section without departing from the spirit and scope of the present invention.

It will be understood that when an element is referred to as being "on," "connected to," or "coupled to" another element, it can be directly on, connected to, or coupled to the other element, or one or more intervening elements may be present. In addition, it will also be understood that when an element is referred to as being "between" two elements, it can be the only element between the two elements, or one or more intervening elements may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "having," "comprises," "comprising," "includes," and "including," when used in this specification, specify the presence of the stated features, integers, steps, operations, elements, and/or components but do not preclude the presence or addition of one or more other features, integers, steps, operations, elements, components, and/or groups thereof. That is, the processes and methods described herein are not limited to the operations indicated and may include additional operations or may omit some operations, and the order of the operations may vary according to some embodiments. As used herein, the term "and/or" includes any and all combinations of one or more of the associated listed items. Expressions, such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "example" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
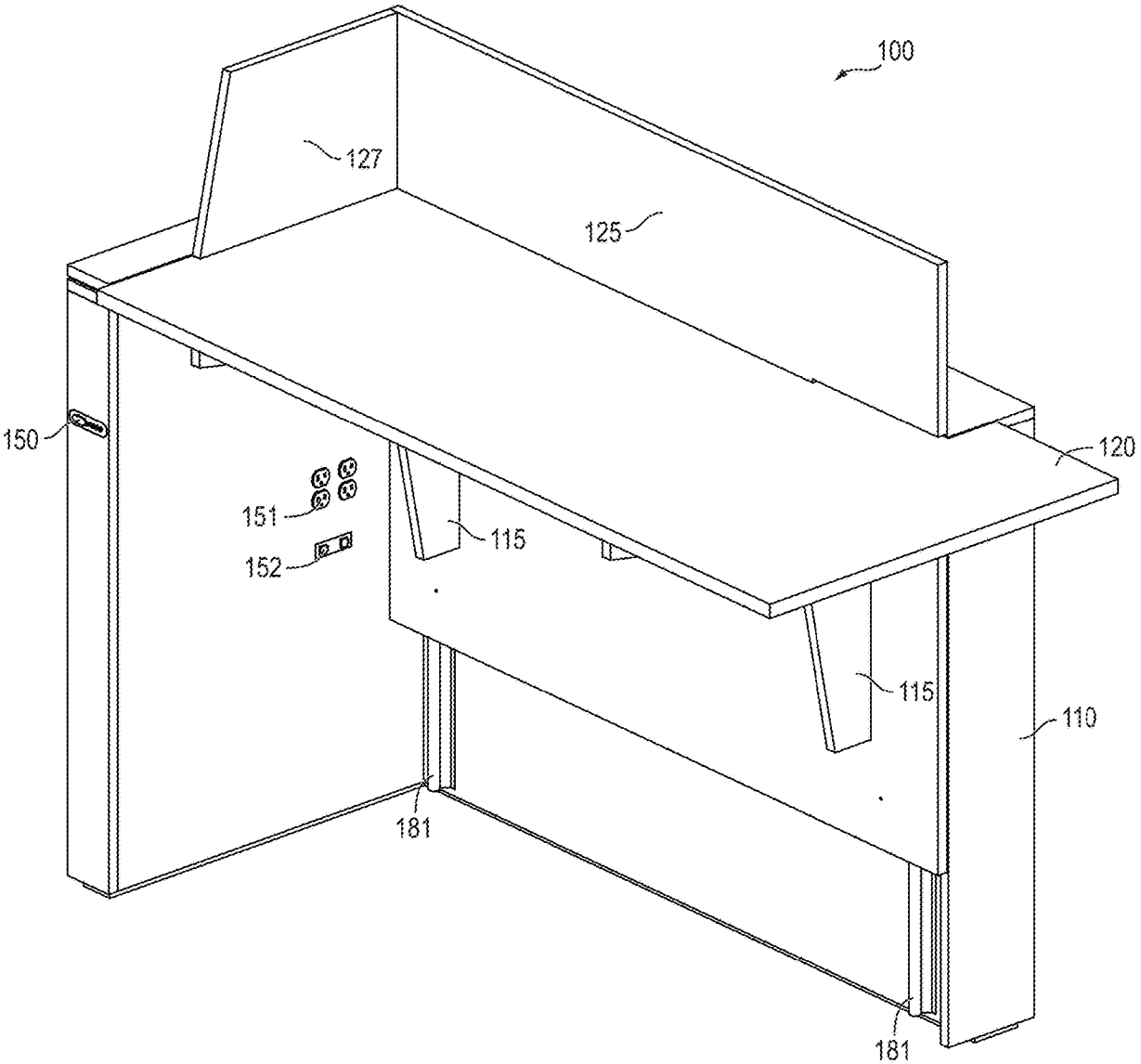
FIG. 2 is a perspective view of the variable height desk shown in FIG. 1 in a raised position.
Figure 3:
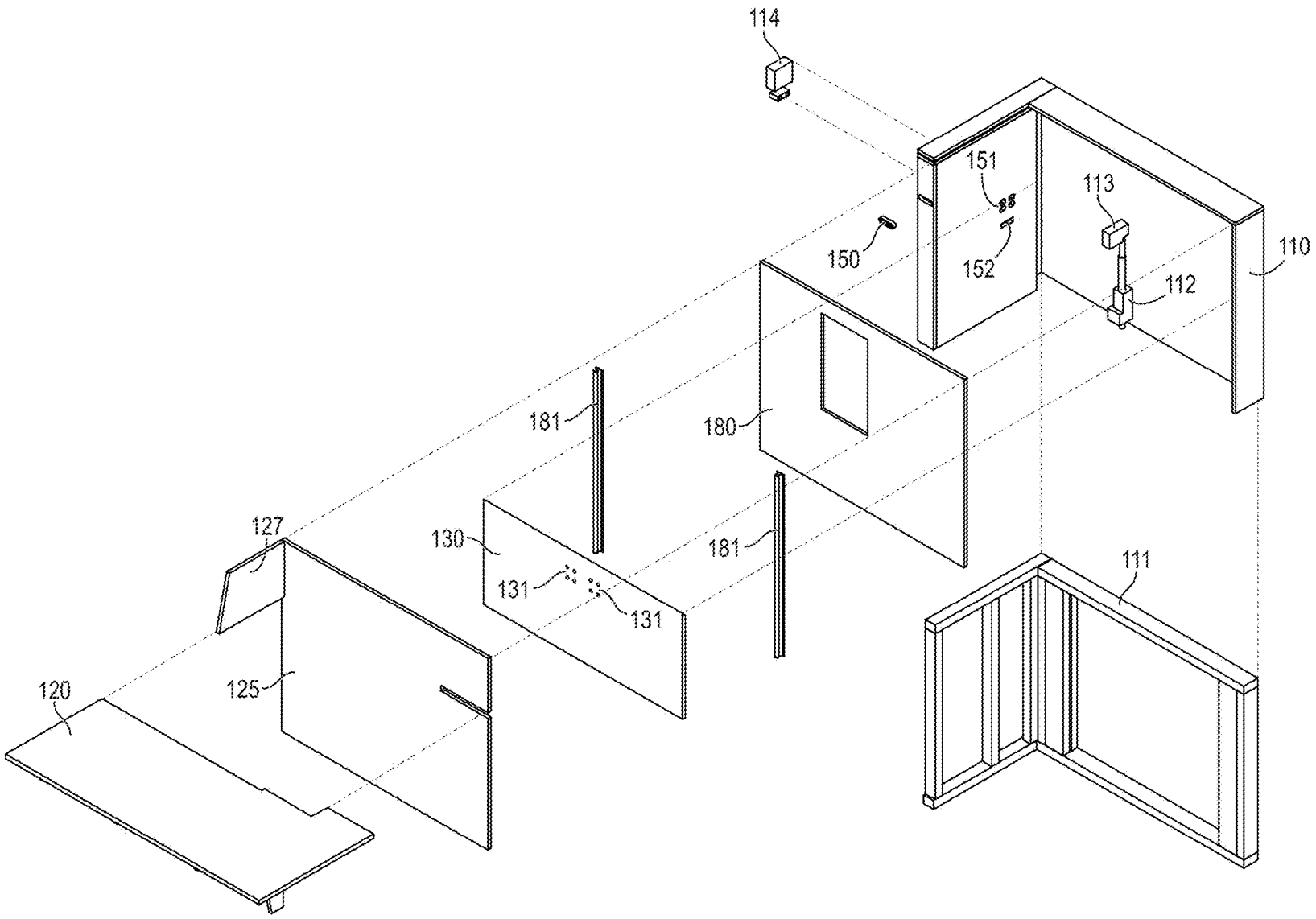
FIG. 3 is an exploded perspective view of the variable height desk shown in FIGS. 1 and 2.

FIGS. 1-3 show a variable height desk according to a first embodiment of the present invention. In FIG. 1, a variable height desk 100 is shown in a lowered, or seated, position, and in FIG. 2, the variable height desk 100 is shown in a raised, or standing, position. FIG. 3 is an exploded perspective view of the variable height desk Referring to FIGS. 1-3, the variable height desk 100 includes a main support 111, a plurality of linear guides 181 mounted to the main support 111, a desk mounting panel 130 having a plurality of linear bearings (e.g., pillow blocks, linear guide blocks, ball bearing blocks, track rollers, etc.) 182 (see, e.g., FIG. 6) mounted thereto, a privacy screen 125, and a desk surface 120 mounted to the privacy screen 125. An actuator 112 is accommodated in the main support 111 and includes a mounting block 113 fixed thereto. Further, a main support cover 110 may be included to cover exterior sides of the main support 111.

In embodiments in which track rollers are used, three track rollers may move along each of the linear guides 181 to stabilize the main support 111 as it is raised and lowered. The track rollers may be arranged around a circumference (or periphery) of the linear guide 181 and spaced from each other by about 90° around the linear guide 181.

The main support cover 110 may include a plurality of separate pieces that are removably coupled to the main support 111 and provide a pleasing aesthetic appearance. The main support cover 110 may be made of wood, wood veneer, MDF, laminate, plastic, metal, etc. Further, the pieces of the main support cover 110 may come in different colors so a user can optionally change the desk's color.

The main support 111 may be substantially L-shaped, with a shorter length portion that extending toward the desk surface 120 to ensure that the variable height desk 100 is stable and a longer length portion that extending substantially perpendicularly to the shorter length portion. The main support 111 may be formed of wood, metal, etc. In some embodiments, the main support 111 may have a frame structure in which a plurality of separate pieces are connected together, for example, screwed, nailed, or welded together, to form the frame structure with various open spaces.

The actuator 112 may be accommodated in the longer length portion of the main support 111. For example, the actuator 112 may be accommodated in one of the open spaces in the longer length portion of the frame structure of the main support 111. The actuator 112 is used to raise/lower the desk surface 120. The actuator 112 may be a worm drive actuator (e.g., worm drive lifting column) having a stroke in a range of 24 in-96 in. However, the present invention is not limited thereto.

The mounting block 113 may be fixed to a distal end of the actuator 112. When the actuator 112 is the worm drive actuator, a position of the actuator 112 may be reliably held in position even when power to the actuator 112 is removed or interrupted. Thereby, safety is improved as the desk surface 120 is unlikely to unexpectedly fall if power is interrupted, and the desk surface 120 may be held at any position along the stroke of the actuator 112, providing additional flexibility for users having different heights and/or preferences.

The actuator 112 may include a DC motor to enable the raising/lowering of the mounting block 113. In this embodiment, a motor controller 114 including an AC/DC converter may be further included to control and power the actuator 112. The motor controller 114 may be accommodated in one of the open spaces in the shorter length portion of the main support 111. In addition, a piece of the main support cover 110 covering an external side of the shorter length portion of the main support 111 may be removable so that the motor controller 114 may be more easily serviced and/or replaced.

A control panel 150 may be provided in the main support 111. For example, the control panel 150 may be mounted in an end of the shorter length portion of the main support 111 facing a user. The control panel 150 may have a plurality of buttons. The buttons may control the up/down movement of the desk surface and may additionally provide saved positions (e.g., saved heights) of the desk surface 120. In some cases, the saved positions may be a fully lowered position, a fully raised position, and a user's preferred standing, or raised, position. By selecting, or pushing, one of the buttons indicating a saved position, the desk surface 120 may move to the corresponding position without the user having to maintain contact with the button.

In addition, a plurality of power outlets (e.g., power plugs) 151 may be provided on an internal side of the main support 111. For example, in the illustrated embodiment, four power outlets 151 are provided; however, the present invention is not limited thereto. The power outlets 151 are arranged about midway up the main support 111 or a little lower than midway up the main support 111.

Also, data ports 152 may also be provided in the main support 111. The data ports 152 may be Ethernet ports for connecting a computer to a local area network (LAN) and/or the Internet. The data ports 152 may be provided near the power outlets 151.

By providing the power outlets 151 and the data ports 152 approximately midway up the main support 111, a risk of items on the desk surface 120 being unplugged, disconnected, or pulled off the desk surface 120 by a power cord or Ethernet cable as the desk surface 120 raises is reduced.

A cover panel 180 may be coupled to the main support 111. For example, the cover panel 180 may be coupled to the longer length portion of the main support 111 and on a side thereof facing toward the desk surface 120, such that the cover panel 180 is arranged between the main support 111 and the desk surface 120. The cover panel 180 may have an opening (e.g., a hole) therein permitting connection between the mounting block 113 of the actuator 112 and the desk mounting panel 130. For example, screws, bolts, or the like may extend through the opening in the cover panel 180 to connect the mounting block 113 with the desk mounting panel 130.

The plurality of linear guides 181 may be fixedly mounted to the cover panel 180. For example, in the embodiment illustrated in FIG. 2, two linear guides 181 are illustrated; but the present invention is not limited thereto. The linear guides 181 extend parallel to the raise/lower direction of the desk surface 120 and ensure alignment of the desk surface 120 during movement and use.

The desk mounting panel 130 is connected to the actuator 112 via the mounting block 113 and is raised/lowered by the actuator 112. For example, the desk mounting panel 130 may be screwed or bolted to the mounting block 113 via one set of mounting openings (e.g., mounting holes) 131. The mounting openings 131 are further described below with respect to FIGS. 4-6.

Figure 6:
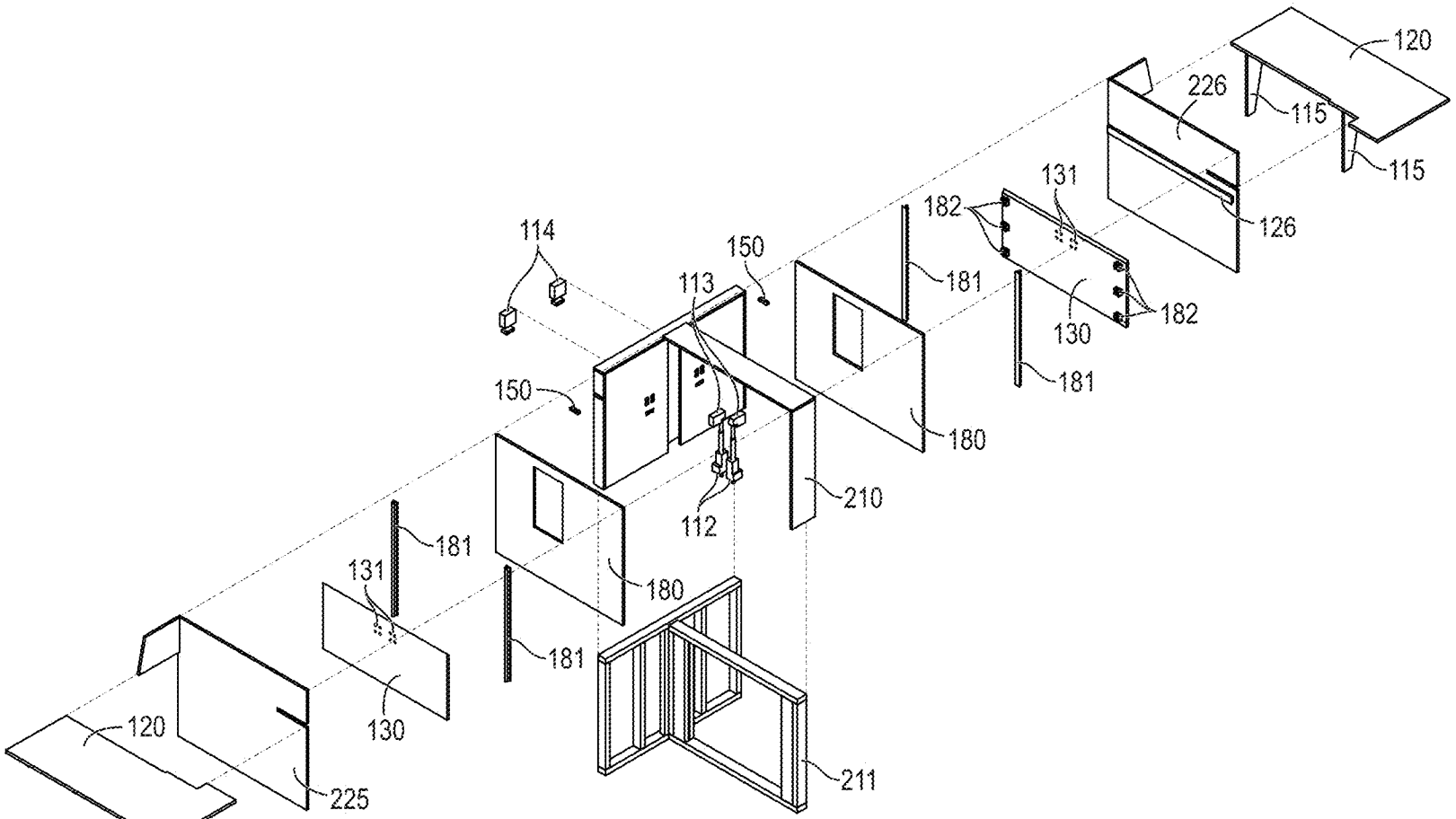
FIG. 6 is an exploded perspective view of the variable height desk shown in FIGS. 4 and 5.

The plurality of linear bearings 182 are mounted to a rear side of the desk mounting panel 130 and are slidably mounted to the linear guides 181 (see, e.g., FIG. 6). For example, six linear bearings 182 may be fixed to the desk mounting panel 130, with three of the linear bearings 182 slidably coupled to one of the linear guides 181 and the other three of the linear bearings 182 slidably coupled to the other one of the linear guides 181; but the present invention is not limited thereto.

When the user presses one of the buttons on the control panel 150, such as the up/raise button, the actuator 112 is activated and extends upwardly. Because the desk mounting panel 130 is coupled to the actuator 112 via the mounting block 113, the desk mounting panel 130 raises as the actuator 112 extends upwardly. As the desk mounting panel 130 moves upwardly, the linear bearings 182 ride along the linear guides 181 to ensure that the desk surface 120 stays flat or substantially flat and to prevent the actuator 112 from binding. When the desk surface 120 has reached the user's desired height, the user removes her finger from the button and the actuator 112 ceases extending and holds the desk surface 120 in place.

The operation of the variable height desk 100 is substantially similar when the user desires to lower the desk surface 120.

The privacy screen 125 is removably coupled to the desk mounting panel 130, and the desk surface 120 is fixed to the privacy screen 125. The privacy screen 125 may be removably coupled to the desk mounting panel 130 by a friction cleat connection. For example, an upper edge of the desk mounting panel 130 may be formed or cut at an approximately 45° angle with the angled surface facing toward the cover panel 180. That is, a length (e.g., the length in a height direction of the variable height desk 100) of a surface of the desk mounting panel 130 facing the privacy screen 125 may be greater than a length of an opposite surface of the desk mounting panel 130 facing the cover panel 180.

The privacy screen 125 may include a privacy screen mounting rail 126 that corresponds to the desk mounting panel 130 (see, e.g., FIG. 6). For example, the privacy screen mounting rail 126 may be fixed to a rear surface of the privacy screen 125 facing the desk mounting panel 130. A lower edge of the privacy screen mounting rail 126 is formed or cut at an approximately 45° angle to correspond to the upper edge of the desk mounting panel 130. For example, the angled surface of the lower edge of the privacy screen mounting rail 126 may face toward the privacy screen 125. That is, a length (e.g., the length in the height direction of the variable height desk 100) of a surface of the privacy screen mounting rail 126 facing the privacy screen 125 may be shorter than a length of an opposite surface of the privacy screen mounting rail 126 facing the desk mounting panel 130.

To removably mount the privacy screen 125 and the desk surface 120 to the desk mounting panel 130, a user arranges the privacy screen 125 with the desk surface 120 mounted thereto over and aligned with the desk mounting panel 130 and lowers the privacy screen 125 until the angled surfaces of the privacy screen mounting rail 126 and the desk mounting panel 130 contact each other. Because the privacy screen mounting rail 126 is closely fixed to (e.g., directly contacts) the privacy screen 125, the desk mounting panel 130 becomes engaged between the angled surface of the privacy screen mounting rail 126 and the rear surface of the privacy screen 125, ensuring a stable yet removable connection between the privacy screen 125 and the desk surface 120 with the desk mounting panel 130. Further, due to the configuration of the angled surfaces, as objects are placed on the desk surface 120, such as a computer, etc. and weight on the desk surface 120 is increased, the friction connection between the privacy screen 125 and the desk mounting panel 130 is increased.

The desk surface 120 is fixedly coupled to the privacy screen 125 and moves along with the privacy screen 125. For example, the desk surface 120 may be fixedly coupled to the privacy screen 125 by a plurality of desk surface supports 115. The desk surface supports 115 may be substantially L-shaped supports that are coupled to the privacy screen 125 and a bottom of the desk surface 120 to support the desk surface 120.

An upper portion of the privacy screen 125 extends above the desk surface 120 and provides privacy to a user. For example, the main support 111 is relatively short to allow for better communication between employees in an office. However, in the raised position, contents on the user's desk may be visible to others from all angles due to the relatively short main support 111. The upper portion of the privacy screen 125 ensures that, in the raised position, others in front of or to the side of the desk surface 120 cannot easily view the contents on the desk surface 120. Similarly, the upper portion of the privacy screen 125 prevents the user from being able to look down onto other user's desks from the raised position.

The upper portion of the privacy screen 125 may be modified to extend above the desk surface 120 to different heights. For example, a shorter privacy screen 125 may be used when only a laptop is intended to be placed on the desk surface 120, and a taller privacy screen 125 may be used when a full size monitor is intended to be placed on the desk surface 120 (see, e.g., variable height desk 100.1 in FIG. 7). Because of the quick-change friction cleat connection between the privacy screen 125 and the desk mounting panel 130, a different privacy screen 125 may be quickly swapped out as a user's needs or desires change.

Figure 4:
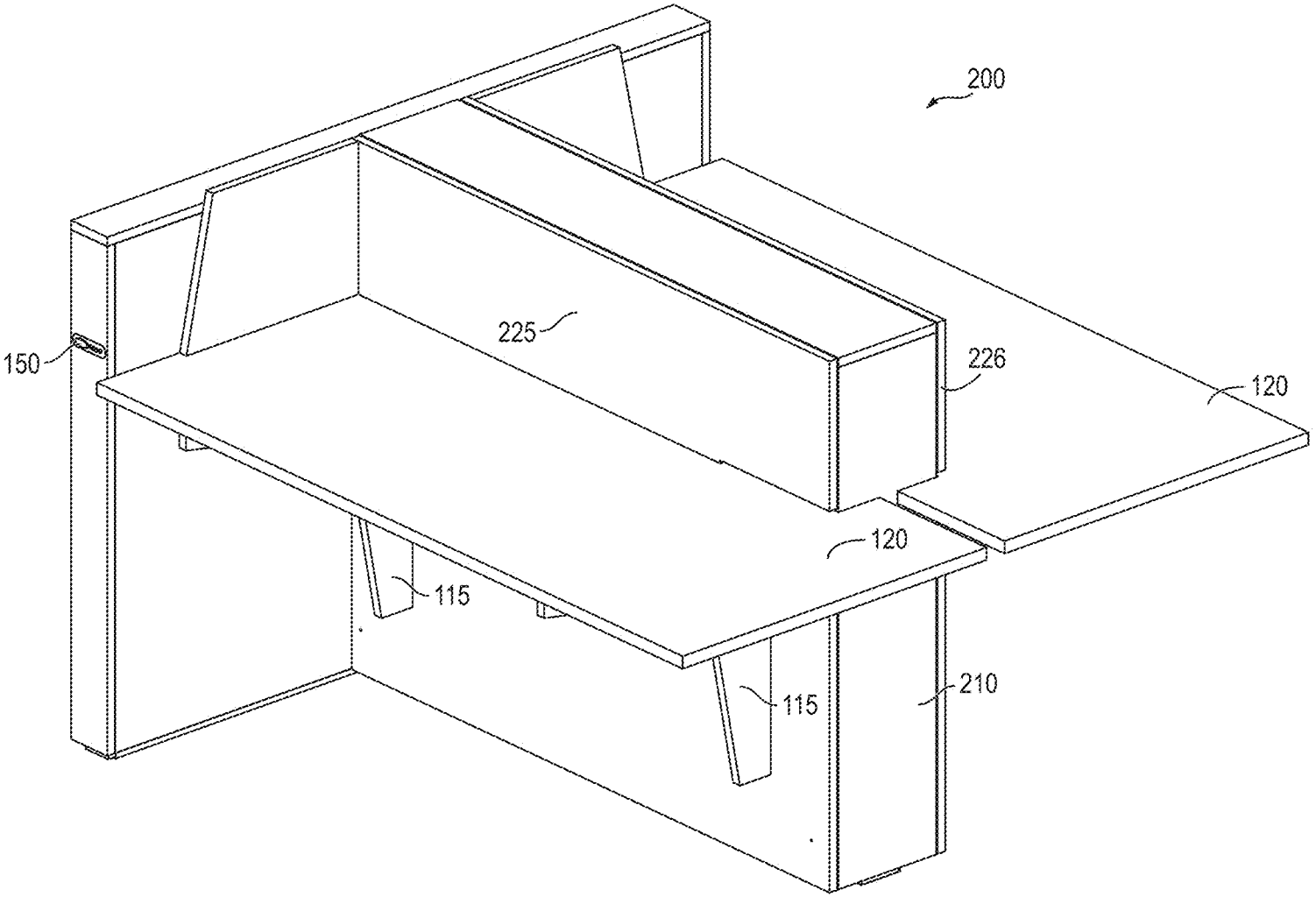
FIG. 4 is a perspective view of a second embodiment of a variable height desk in a lowered position.
Figure 5:
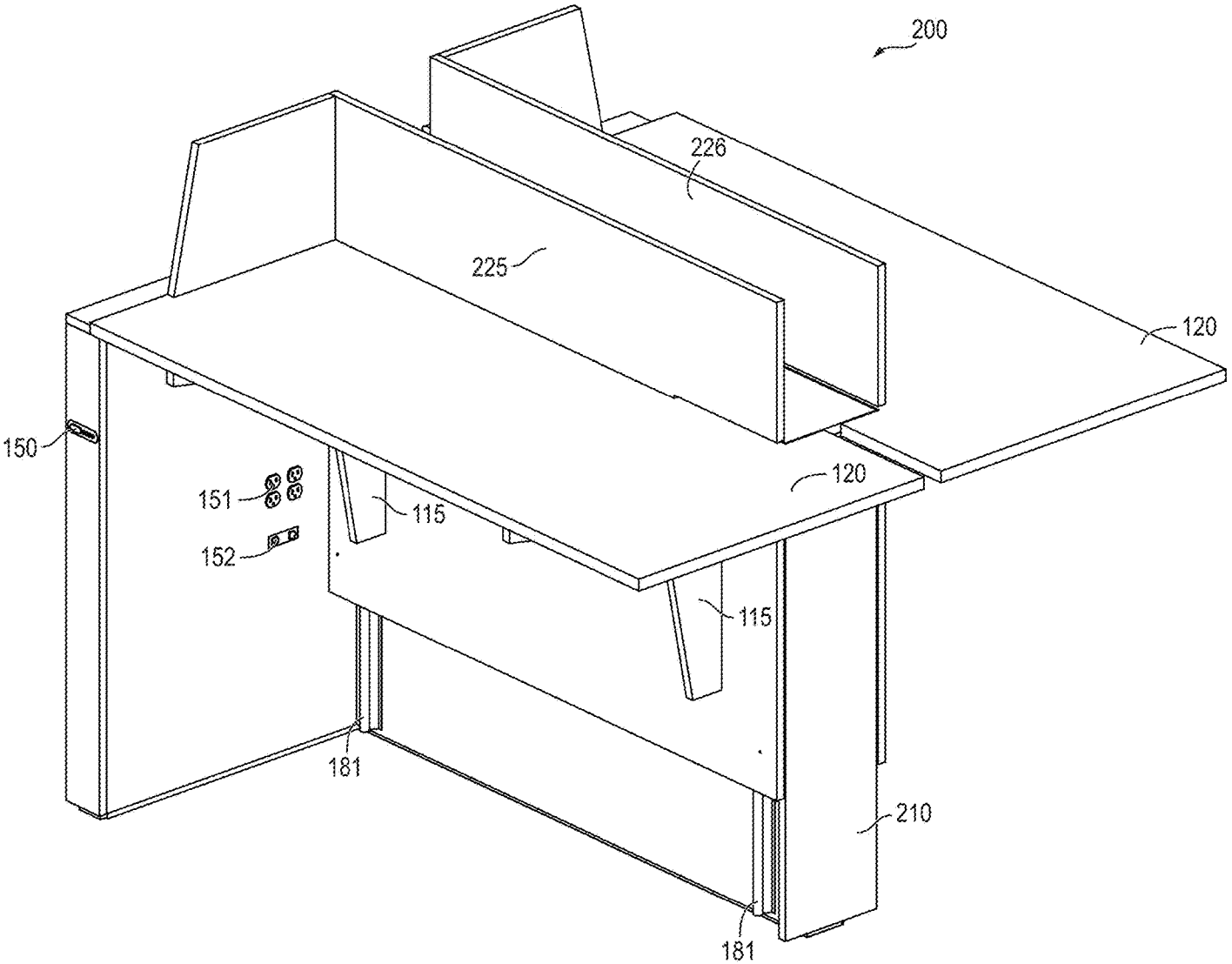
FIG. 5 is a perspective view of the variable height desk shown in FIG. 4 in a raised position.

FIGS. 4-6 show a variable height desk according to a second embodiment of the present invention. For convenience of description, the differences between the first embodiment shown in FIGS. 1-3 and the second embodiment shown in FIGS. 4-6 will be primarily discussed. Elements indicated by the same numerals in FIGS. 1-6 indicate the same or substantially similar elements.

Referring to FIGS. 4-6, a variable height desk 200 includes a main support 211, a plurality of linear guides 181 mounted to the main support 211, a plurality of desk mounting panels 130, each having a plurality of linear bearings 182 mounted thereto, a plurality of privacy screens 225 and 226, and a plurality of desk surfaces 120 respectively mounted to the privacy screens 225 and 226. A plurality of actuators 112 are accommodated in the main support 211, and each of the actuators 112 includes a mounting block 113 fixed thereto. Further, a main support cover 210 may be included to cover exterior sides of the main support 211. For example, the main support cover 210 may include a plurality of separate pieces that are removably coupled to the main support 211 and provide a pleasing aesthetic appearance.

The variable height desk 200 shown in FIGS. 4-6 is similar to the variable height desk 100 shown in FIGS. 1-3 but includes a second desk surface 120 and corresponding components. For example, the main support 211 is substantially T-shaped, different from the substantially L-shaped main support 111 of the variable height desk 100 shown in FIGS. 1-3.

A plurality of actuators 112 are arranged and accommodated in the main support 211. For example, in the illustrated embodiment, two actuators 112 are arranged in the main support 211; but the present invention is not limited thereto. To provide a thinner main support 211, the actuators 112 may be arranged side-by-side in an extension direction of a longer portion (or base portion) of the T-shaped main support 211.

Each of the actuators 112 includes a mounting block 113 fixed thereto. One of the mounting blocks 113 faces towards a first one of the desk surfaces 120, and the other one of the mounting blocks 113 faces towards a second one of the desk surfaces 120.

The two cover panels 180 may be identical or substantially similar to each other. For example, the opening in the cover panels 180 may be large enough such that the cover panel 180 can be used on either side of the main support 211.

Further, the desk mounting panels 130 may be identical or substantially similar to each other. To be interchangeable between the actuators 112, which are arranged side-by-side in the main support 211 as described above, each of the desk mounting panels 130 has two sets of mounting openings (e.g., mounting holes) 131 provided therein. Thus, the desk mounting panel 130 can be connected to either of the actuators 112 on either side of the main support 211. By using an interchangeable desk mounting panel 130, manufacturing and assembly can be simplified.

Similarly, the desk surfaces 120 may be identical or substantially similar to each other. To be used on either side of the main support 211, the desk surface 120 may be flipped. However, to present a more pleasing aesthetic appearance, separate desk surfaces may be provided for each side of the main support 211 so that mounting openings, such as those for the desk surface supports 115, are not visible on a top of the desk surfaces 120.

Ones of the privacy screens 225 and 226 are specific to the sides of the main support 211. However, in other embodiments, an identical or substantially similar privacy screen that is interchangeable between the sides of the main support 211 may be used. For example, when an extended side portion 127 of the privacy screen 125 is omitted (see, e.g., FIGS. 1-3), the privacy screen 125 may be used on either side of the main support 211 interchangeably.

The present invention is not limited to one or two individual desk surfaces 120 movably attached to a main support. Other embodiments of the present invention may include a variable height desk having three individual desk surfaces 120 and corresponding actuators 112 and the like, with two desk surfaces 120 being at opposite sides of the base of the T-shaped main support 211 and a third desk surface 120 being at a top of the T-shaped main support 211. Further embodiments are considered, including four or more individual desk surfaces 120 with corresponding actuators 112 and the like, providing additional sit/stand workstations with a reduced footprint due to housing the raise/lower components in and on a common main support.

Figure 7:
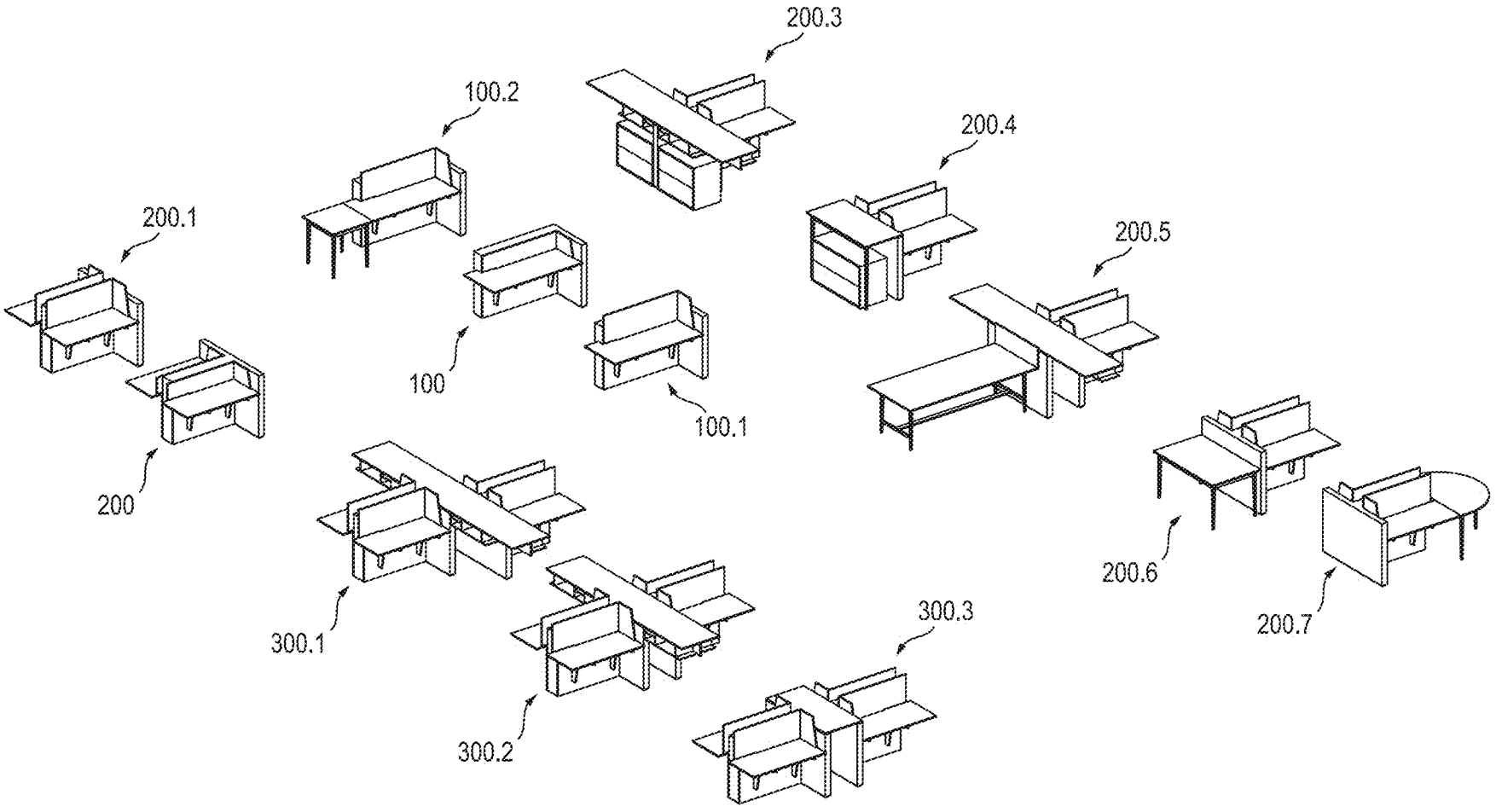
FIG. 7 shows different configurations of variable height desks according to various embodiments of the present invention.
Figure 8:
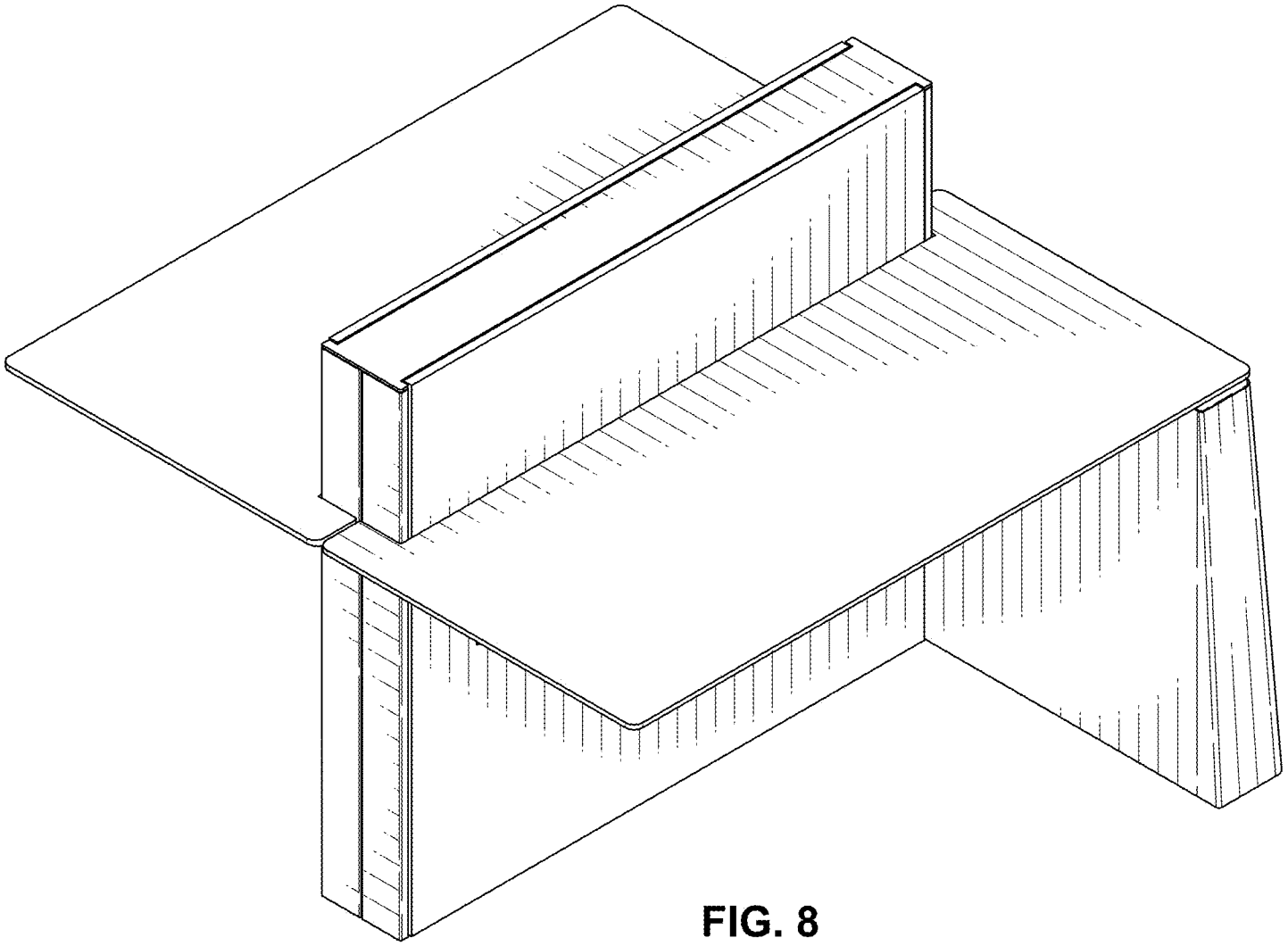
FIGS. 8-23 show different views of a third embodiment of a variable height desk.
Figure 9:
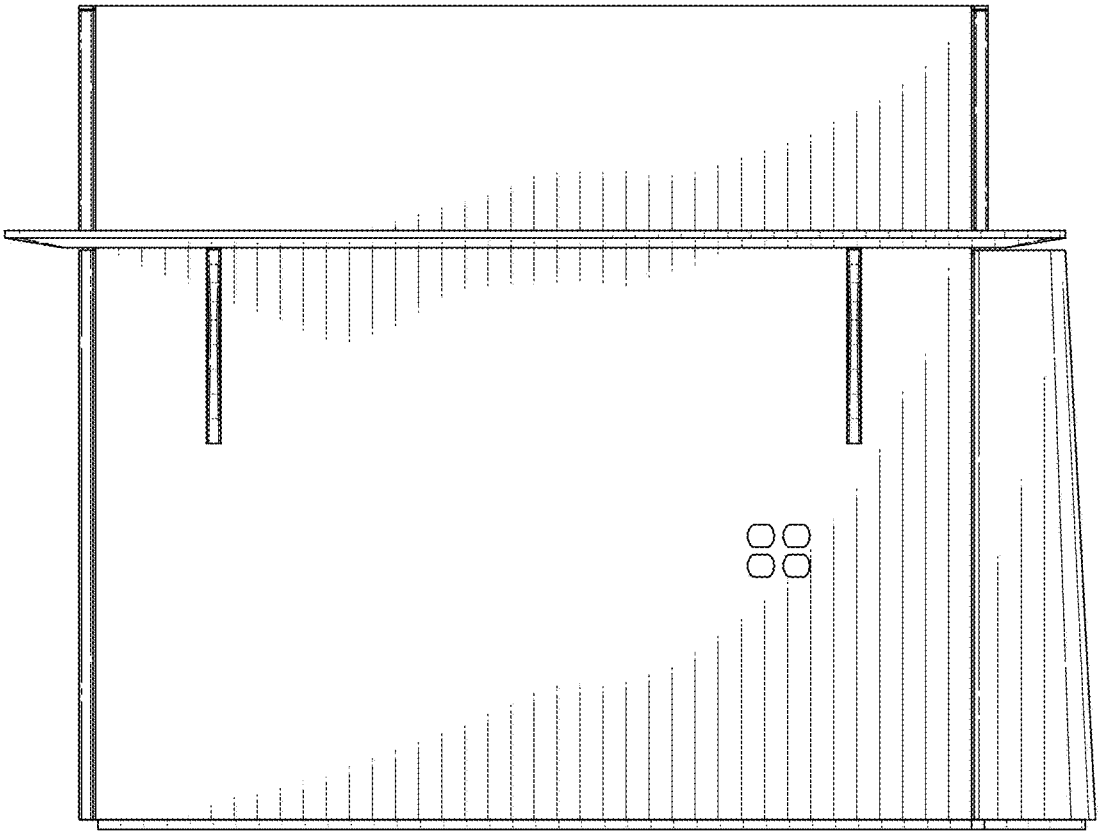
Figure 10:
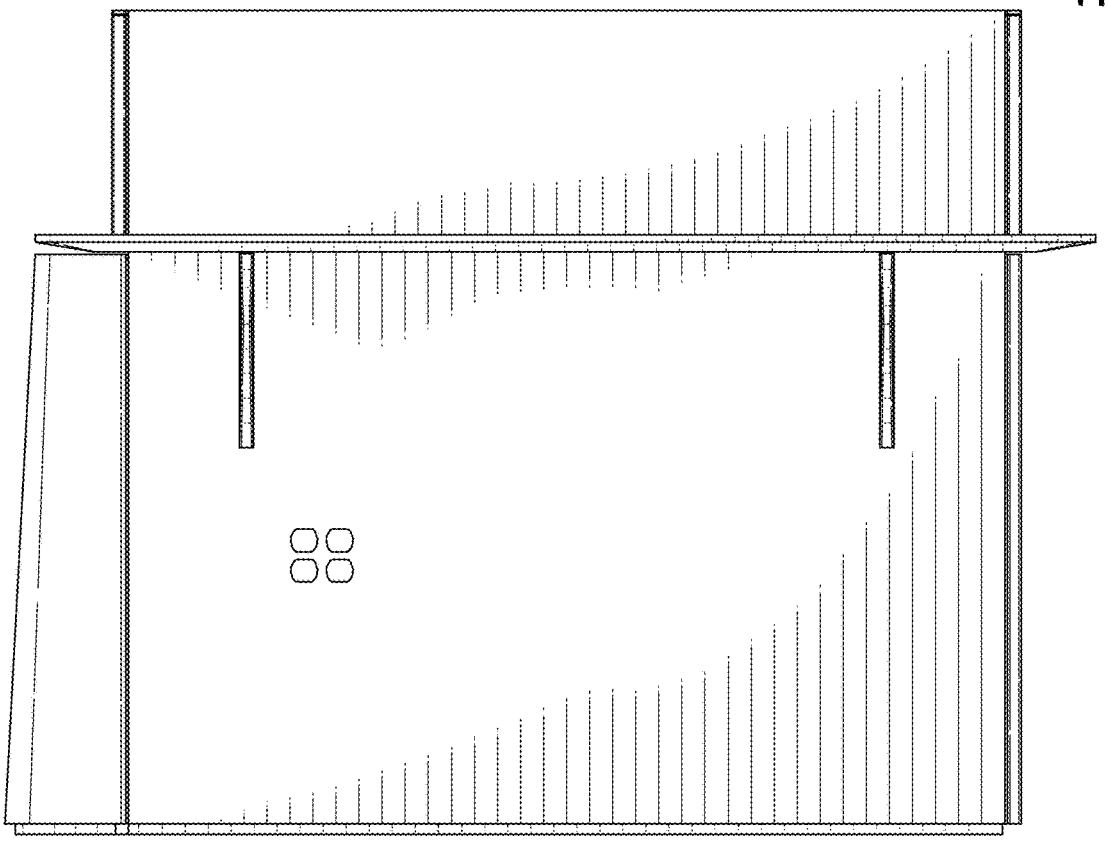
Figure 11:
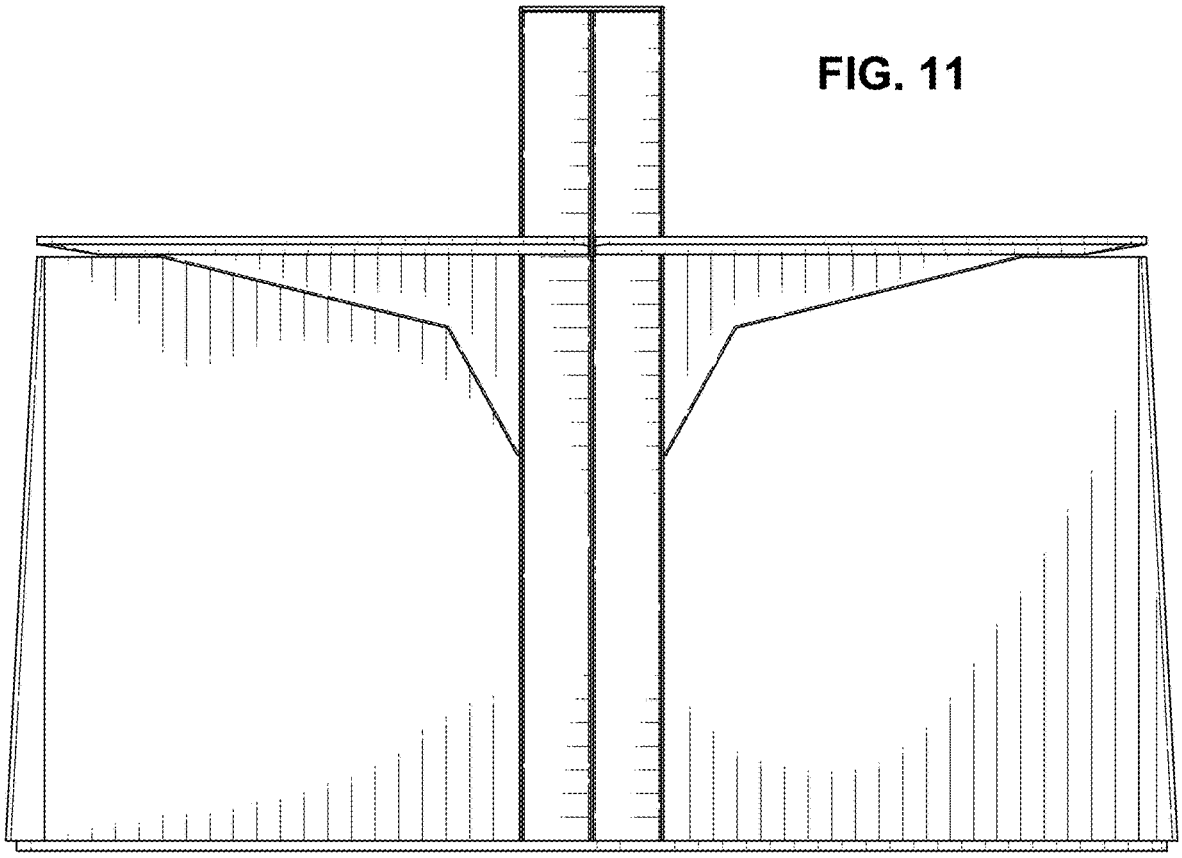
Figure 12:
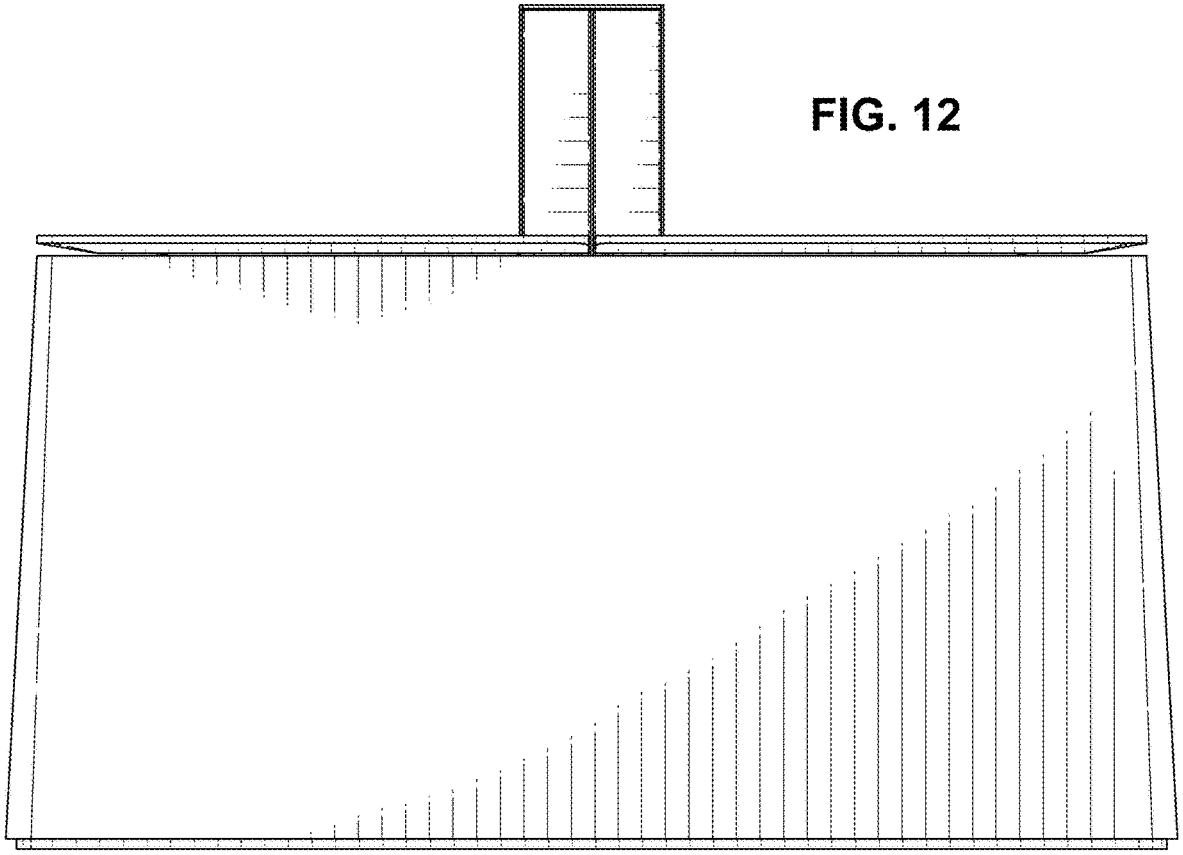
Figure 13:
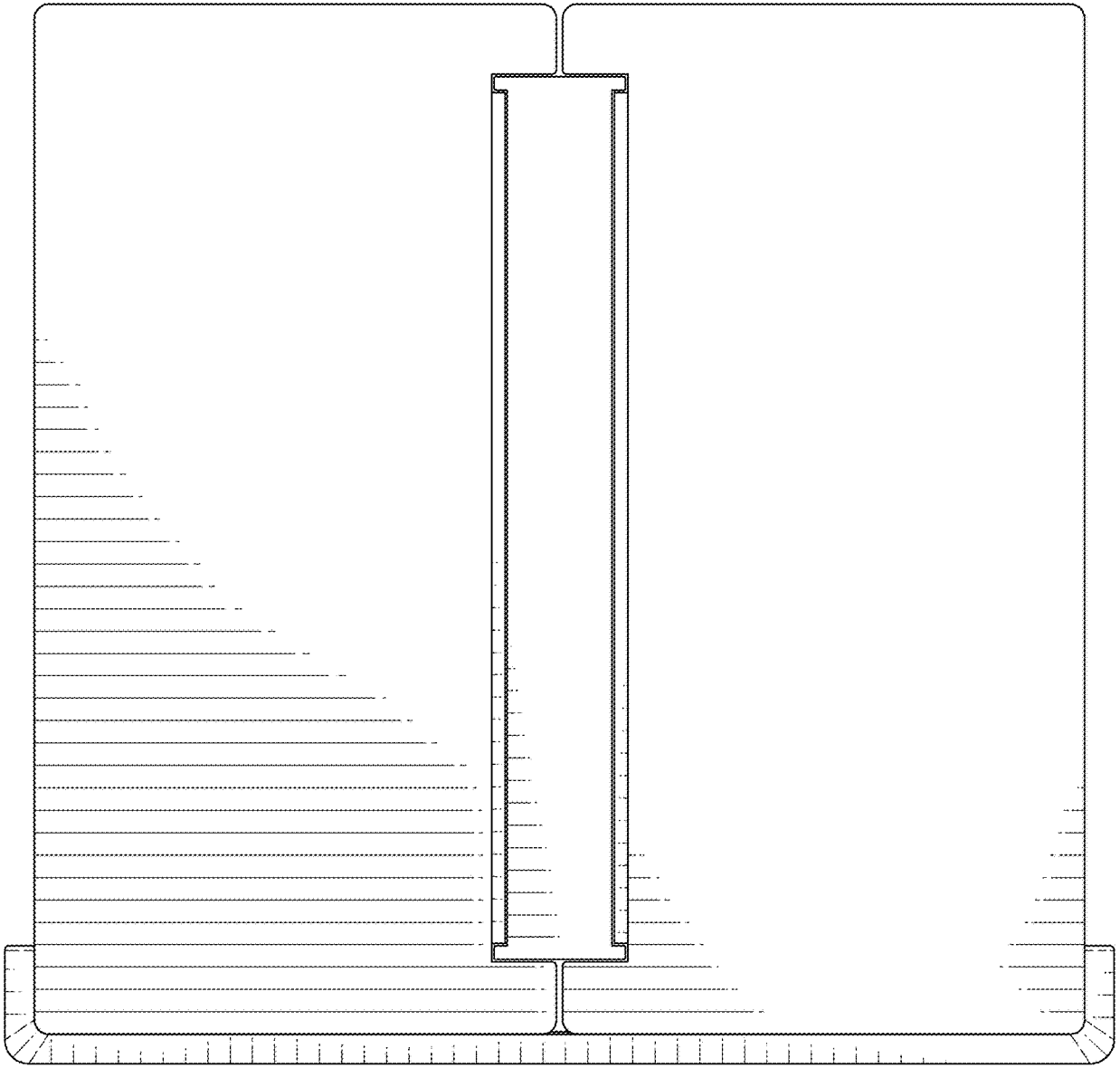
Figure 14:
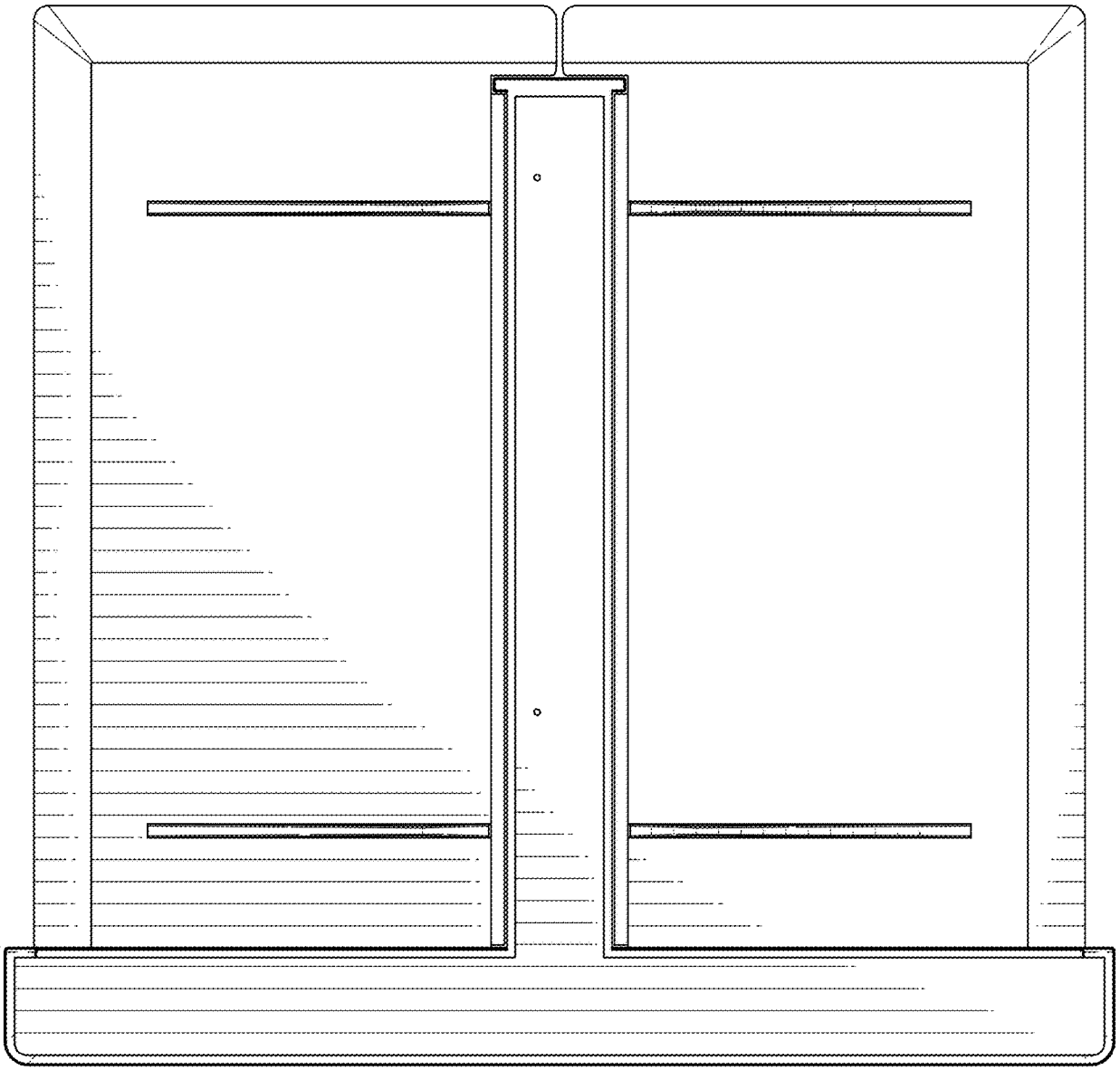
Figure 15:
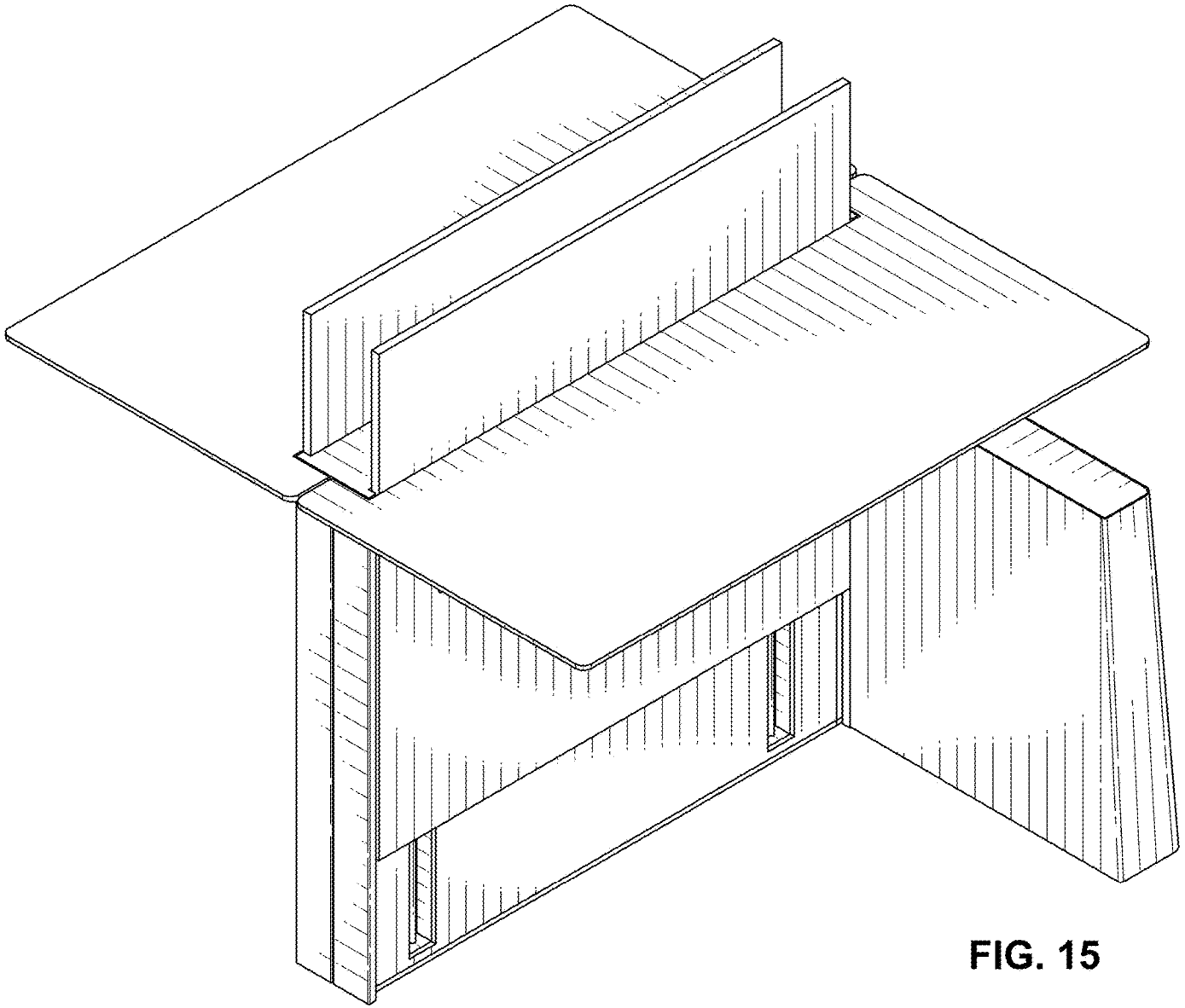
Figure 16:
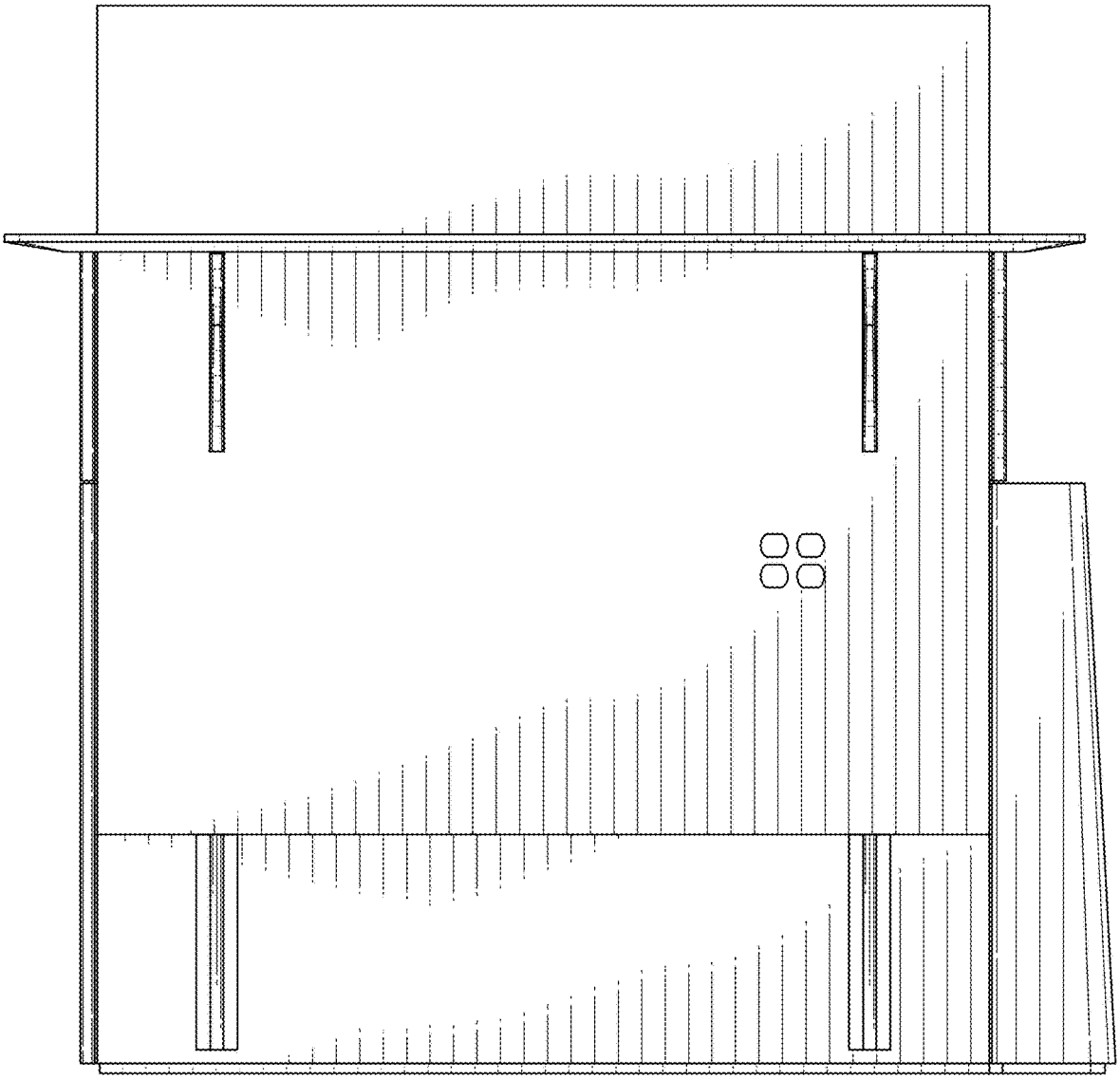
Figure 17:
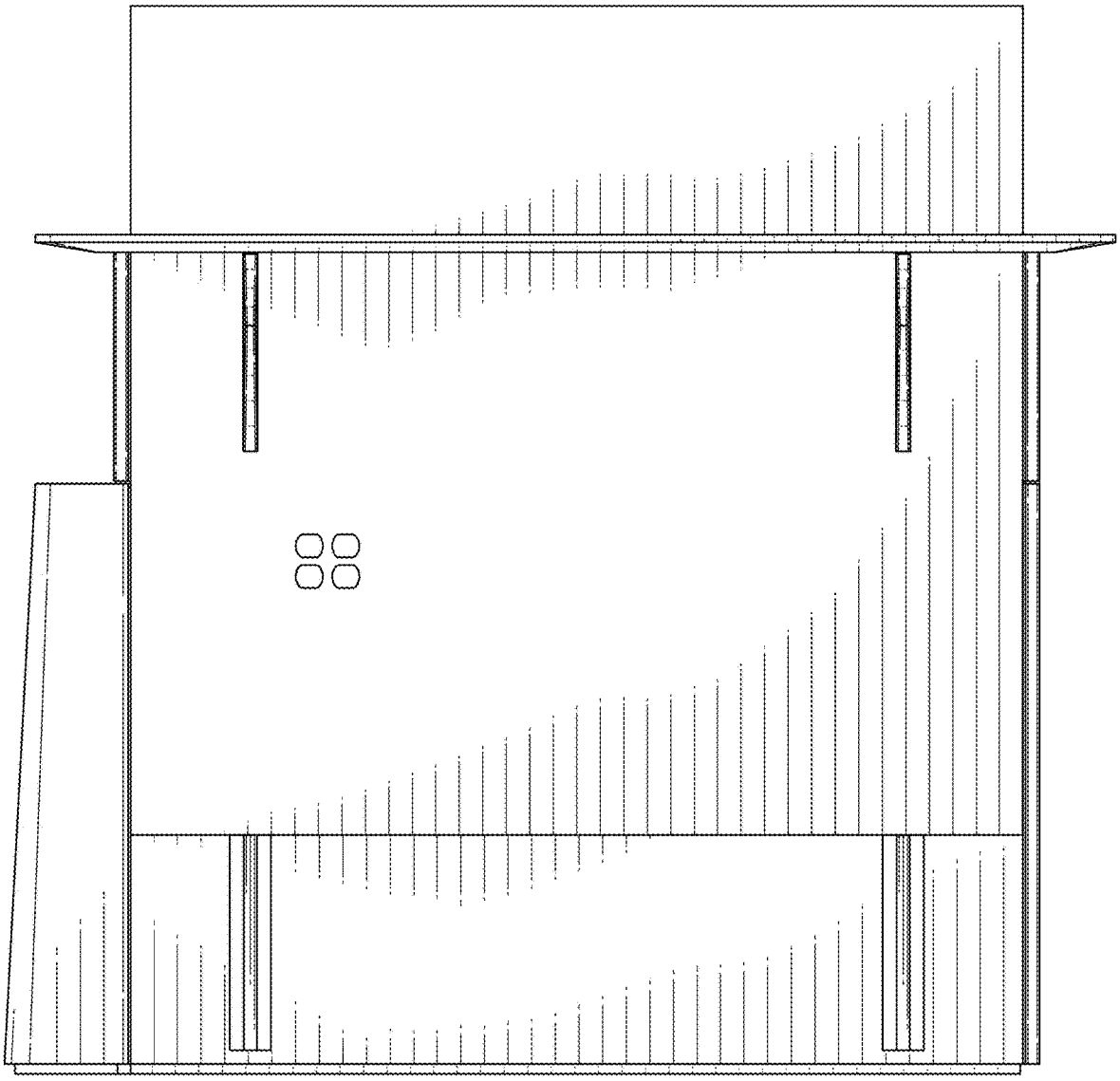
Figure 18:
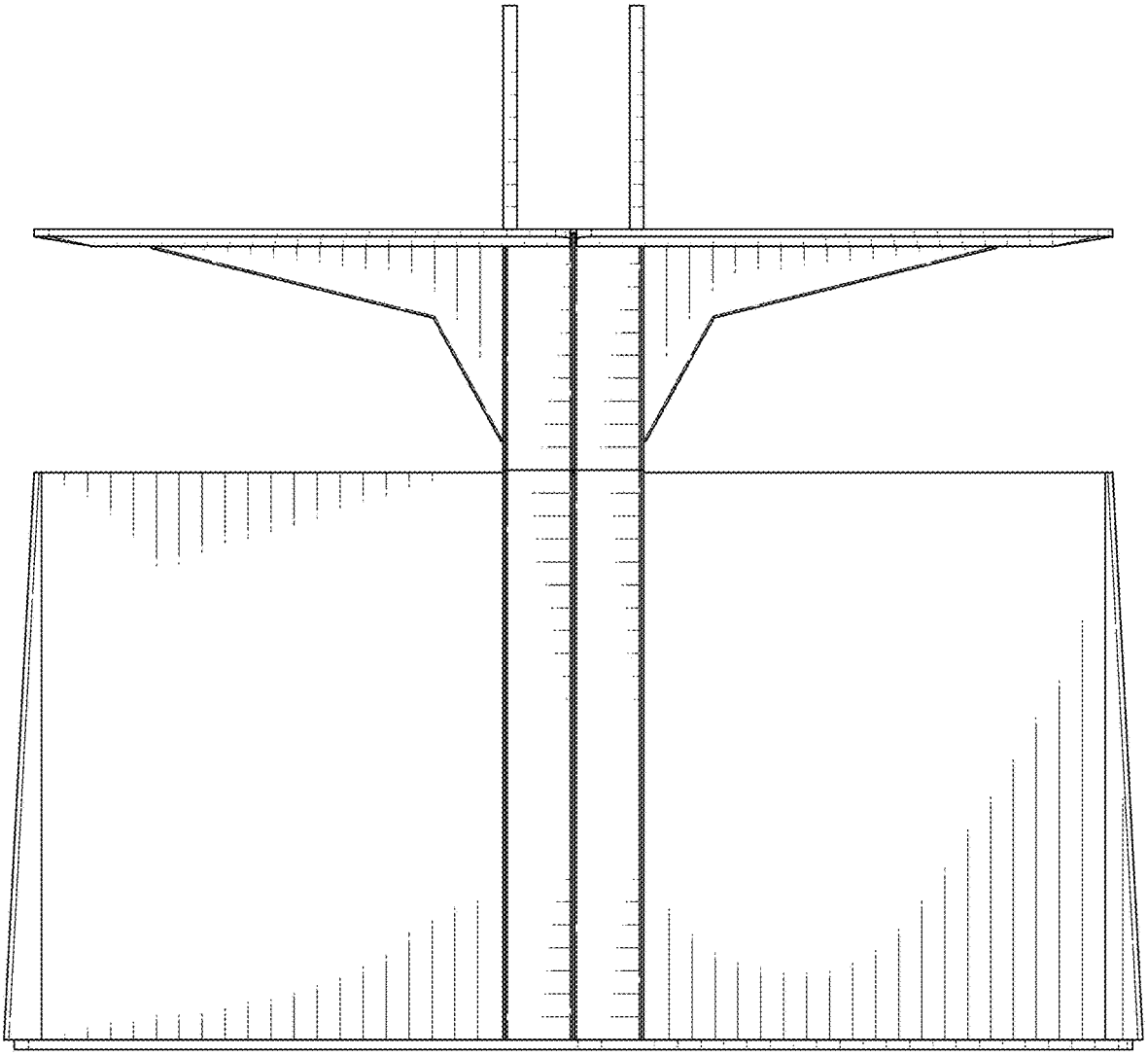
Figure 19:
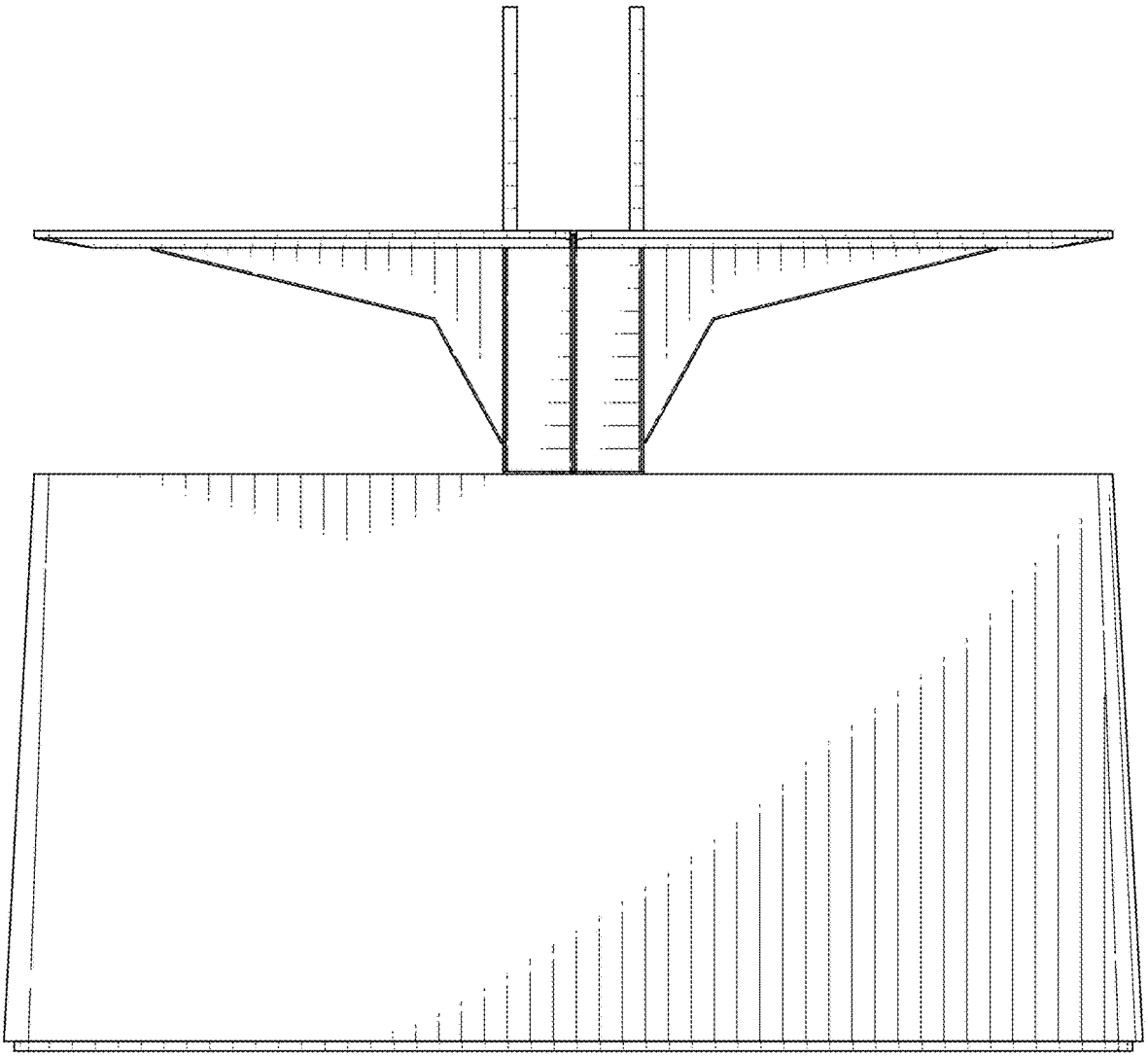
Figure 20:
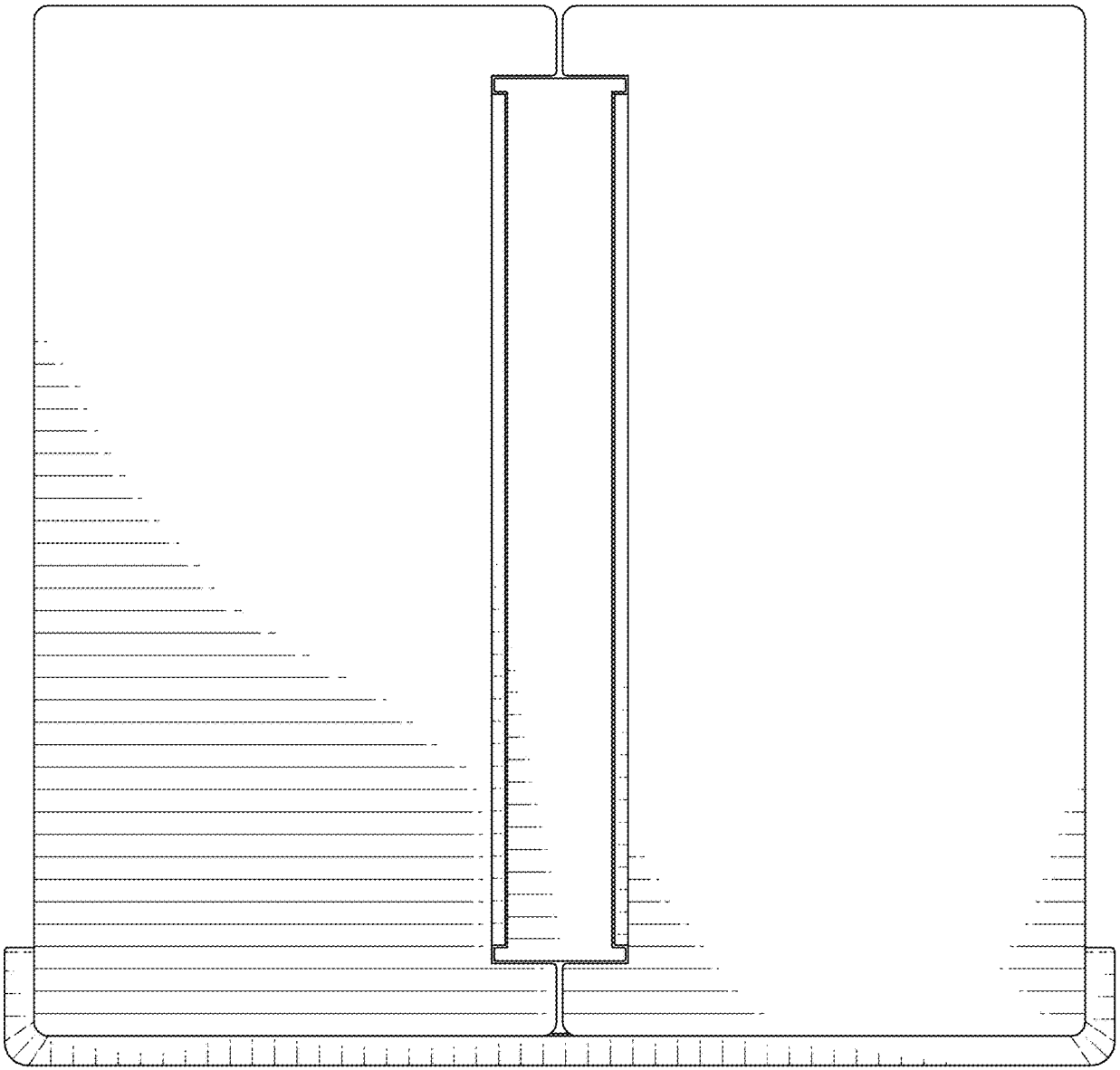
Figure 21:
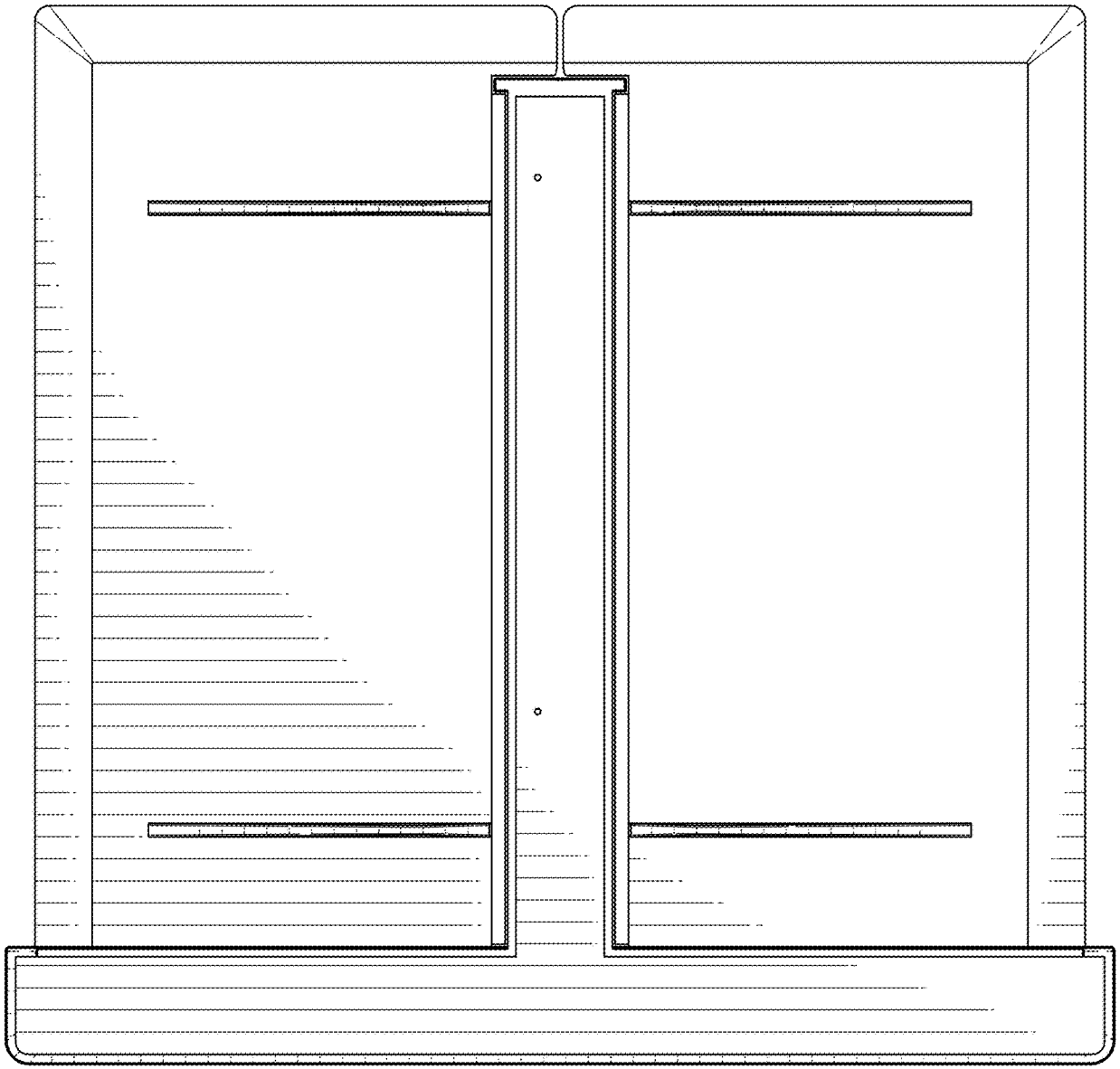
Figure 22:
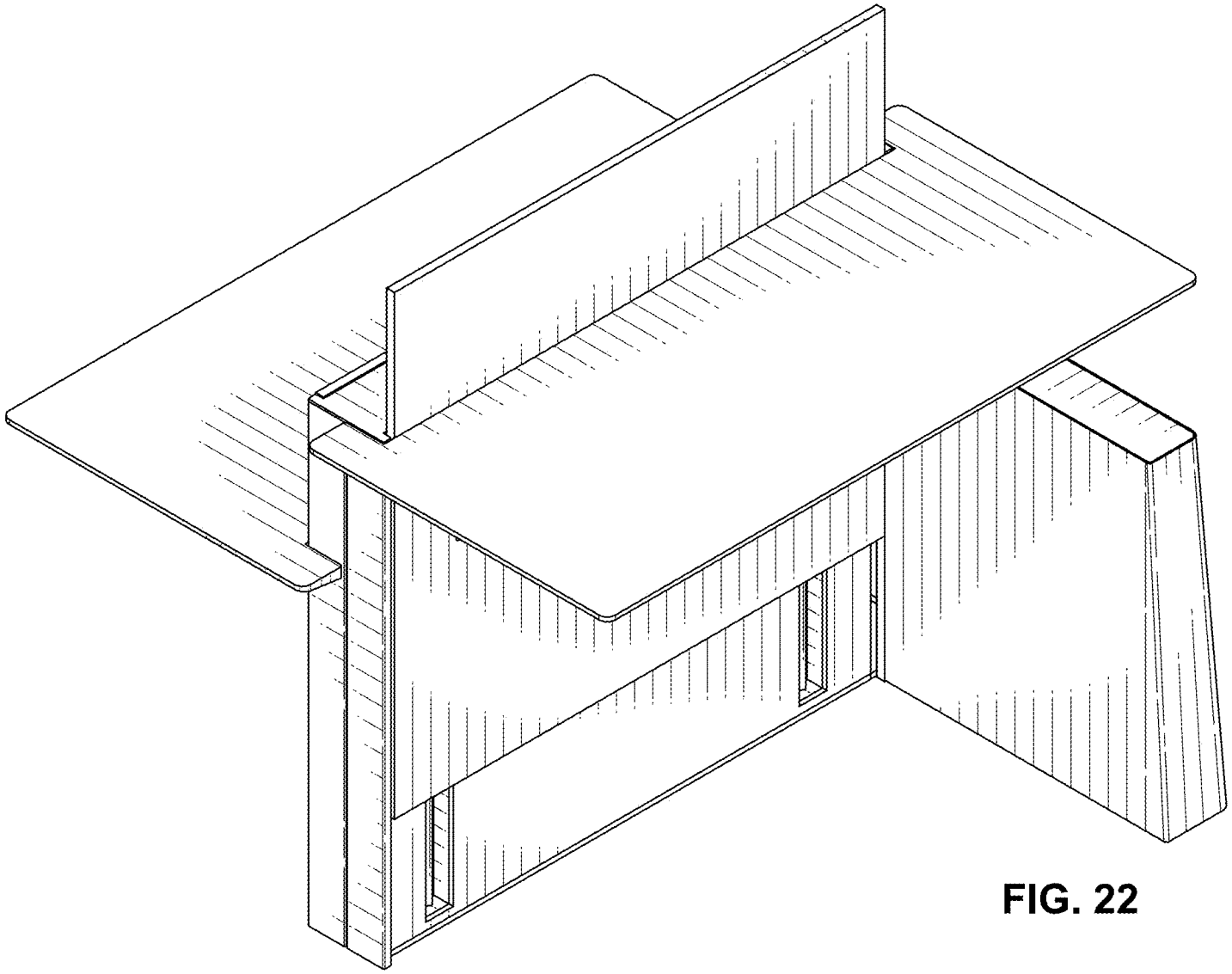
Figure 23:
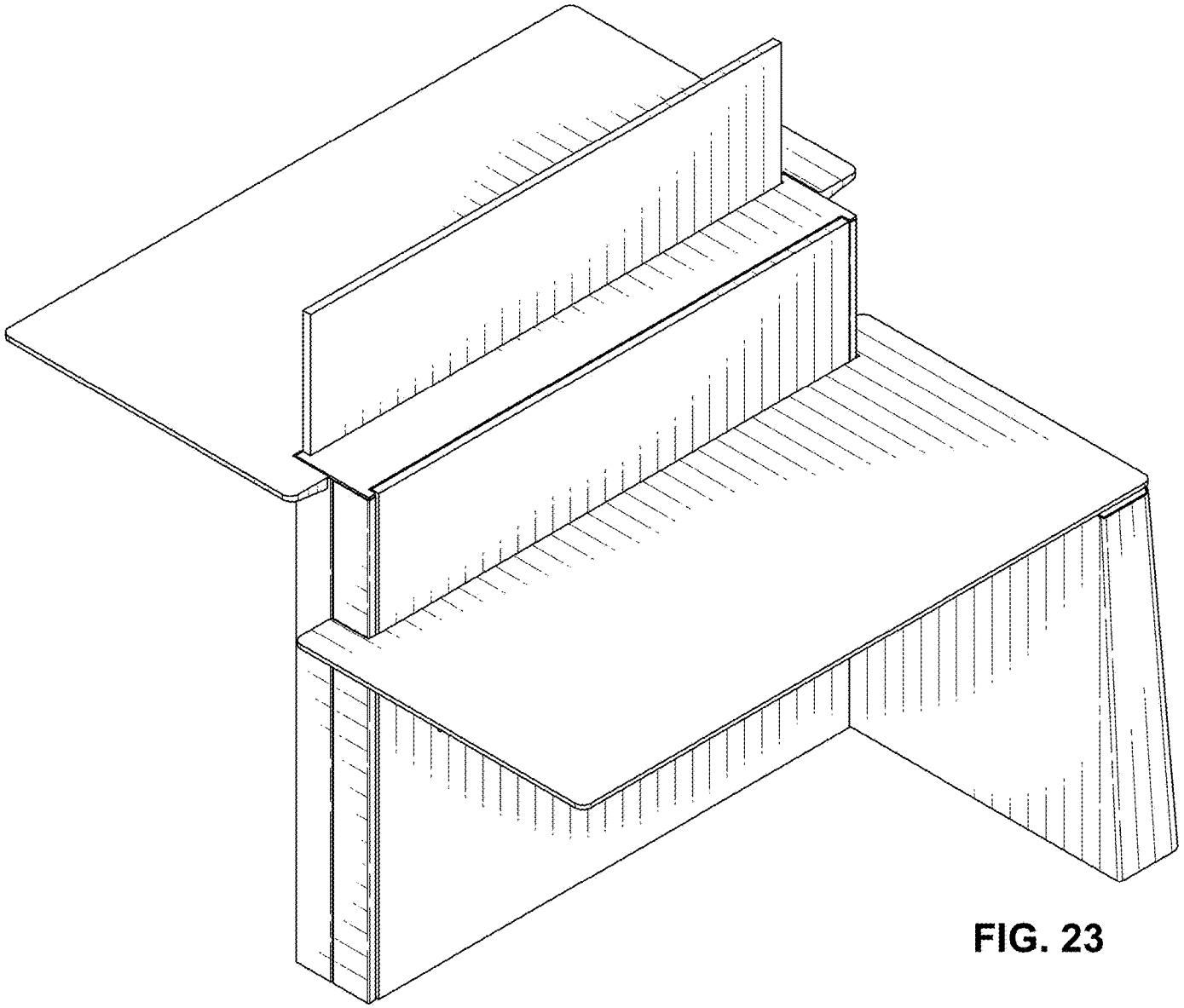
Figure 24:
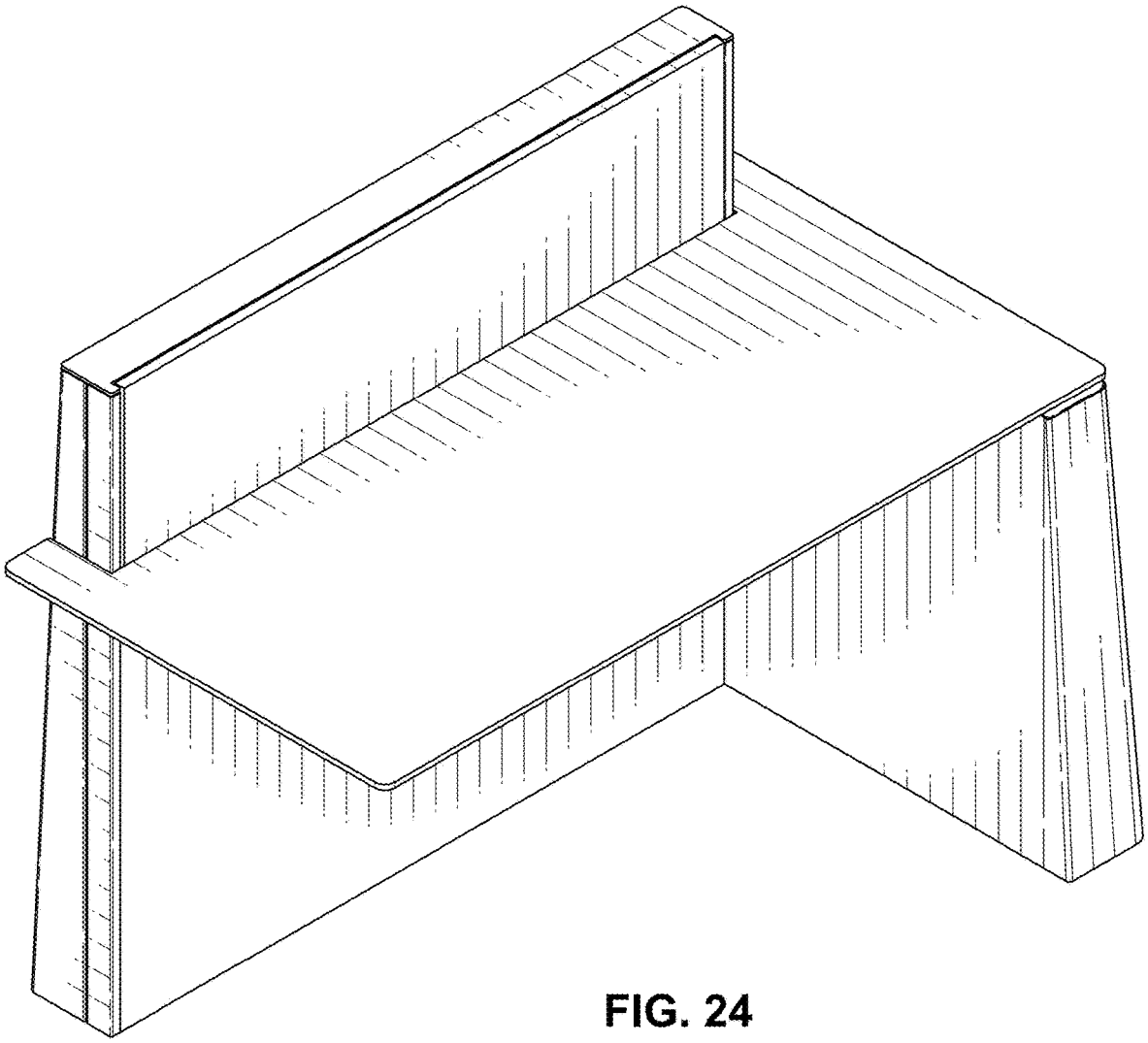
FIGS. 24-37 show different views of a fourth embodiment of a variable height desk.
Figure 25:
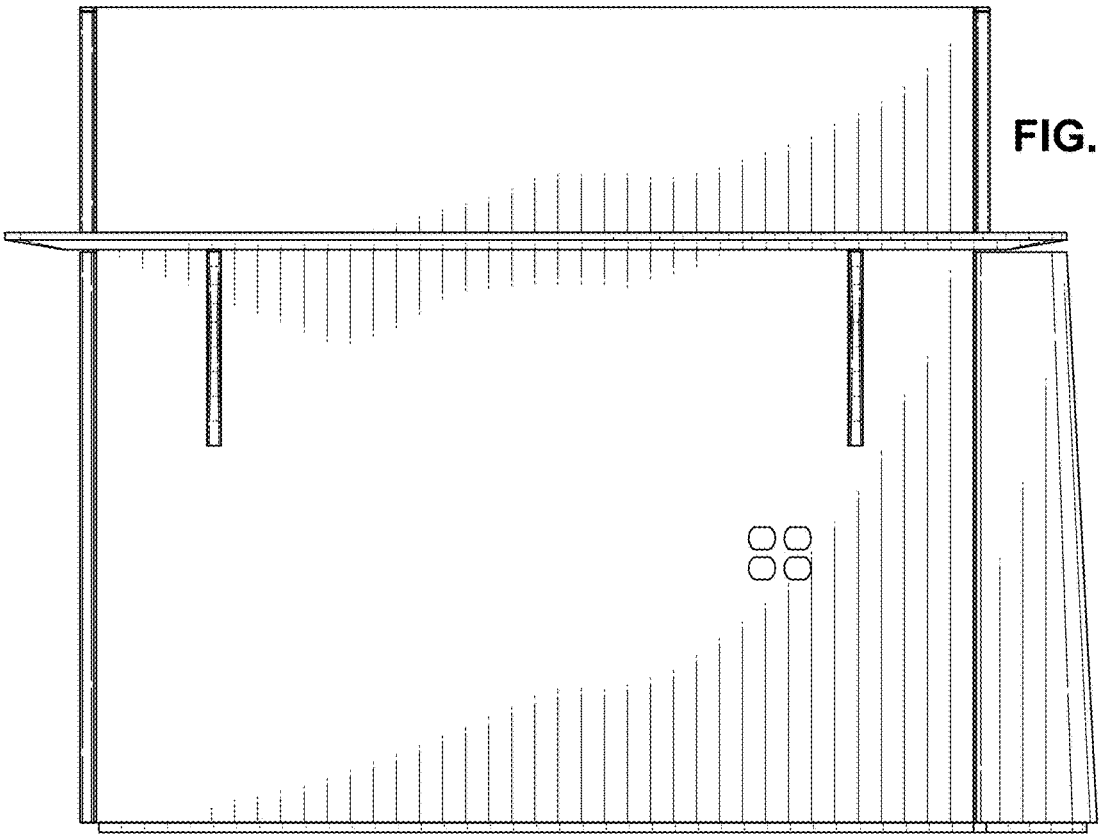
Figure 26:
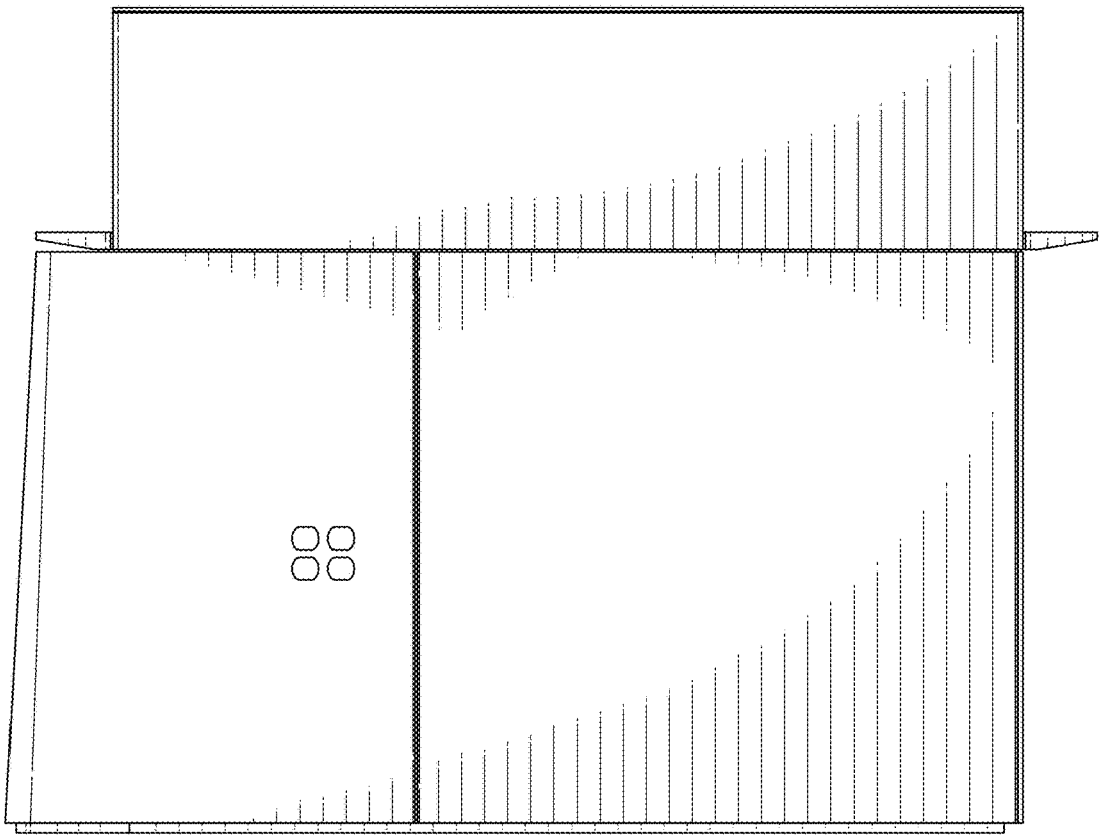
Figure 27:
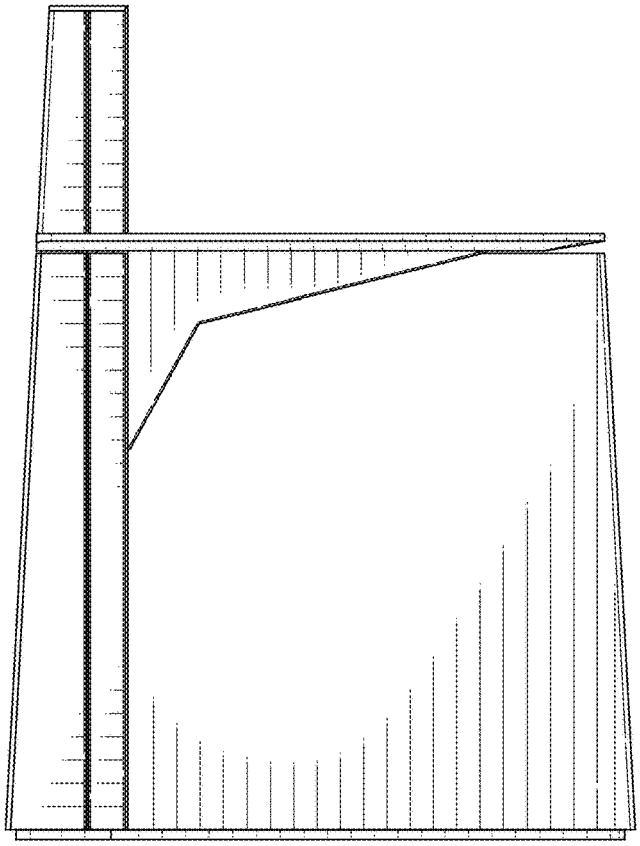
Figure 28:
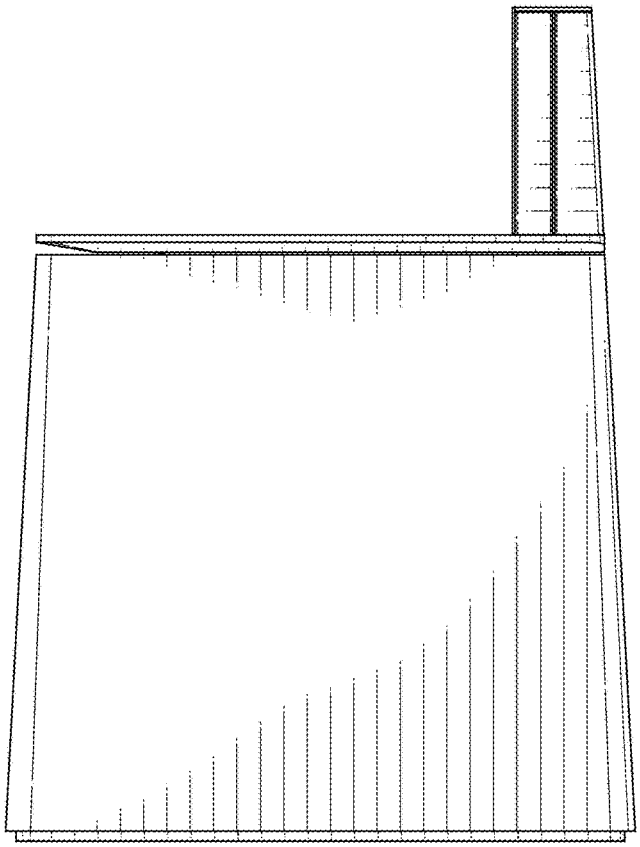
Figure 29:
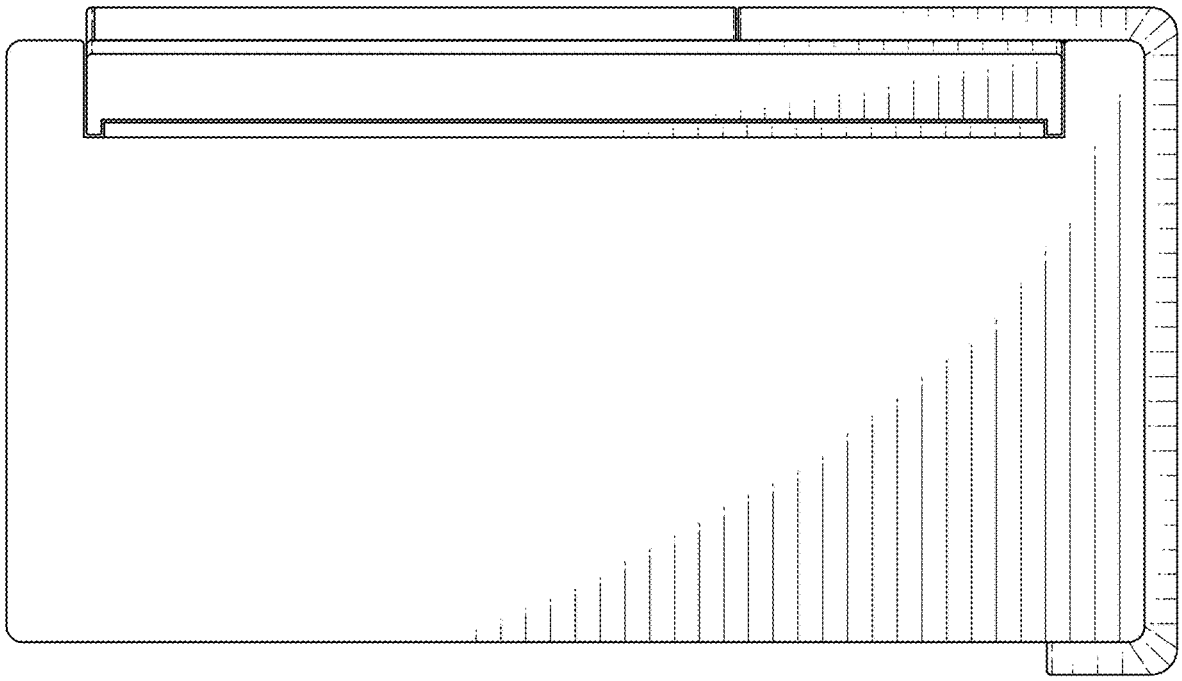
Figure 30:
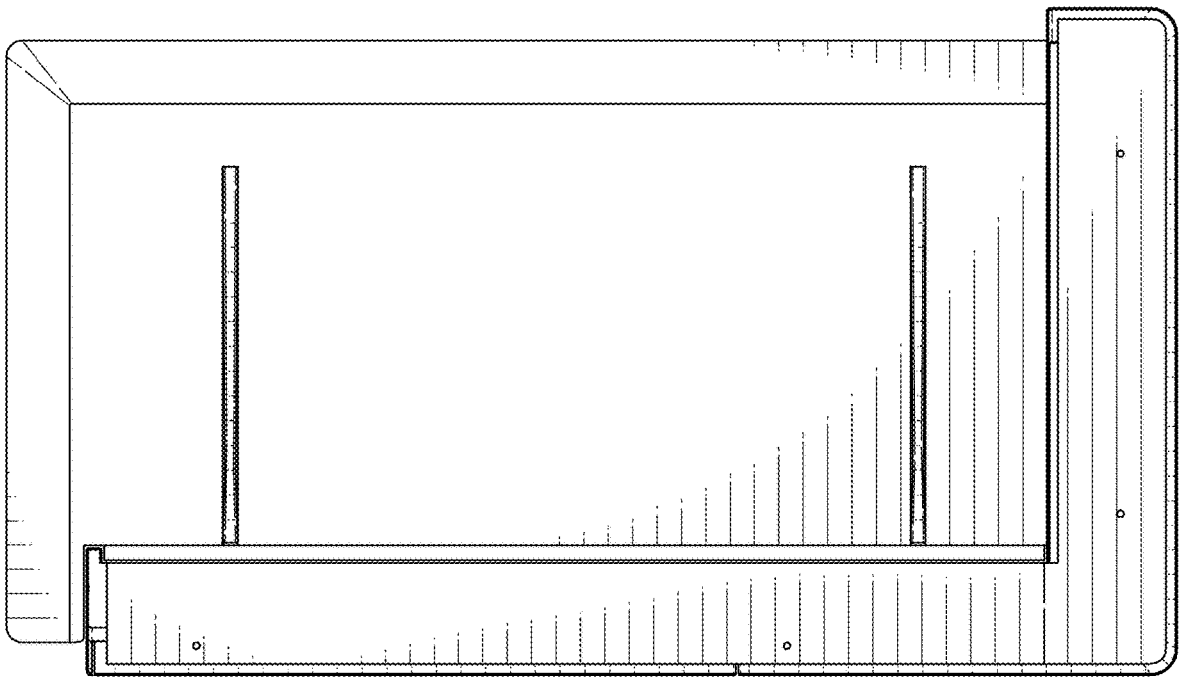
Figure 31:
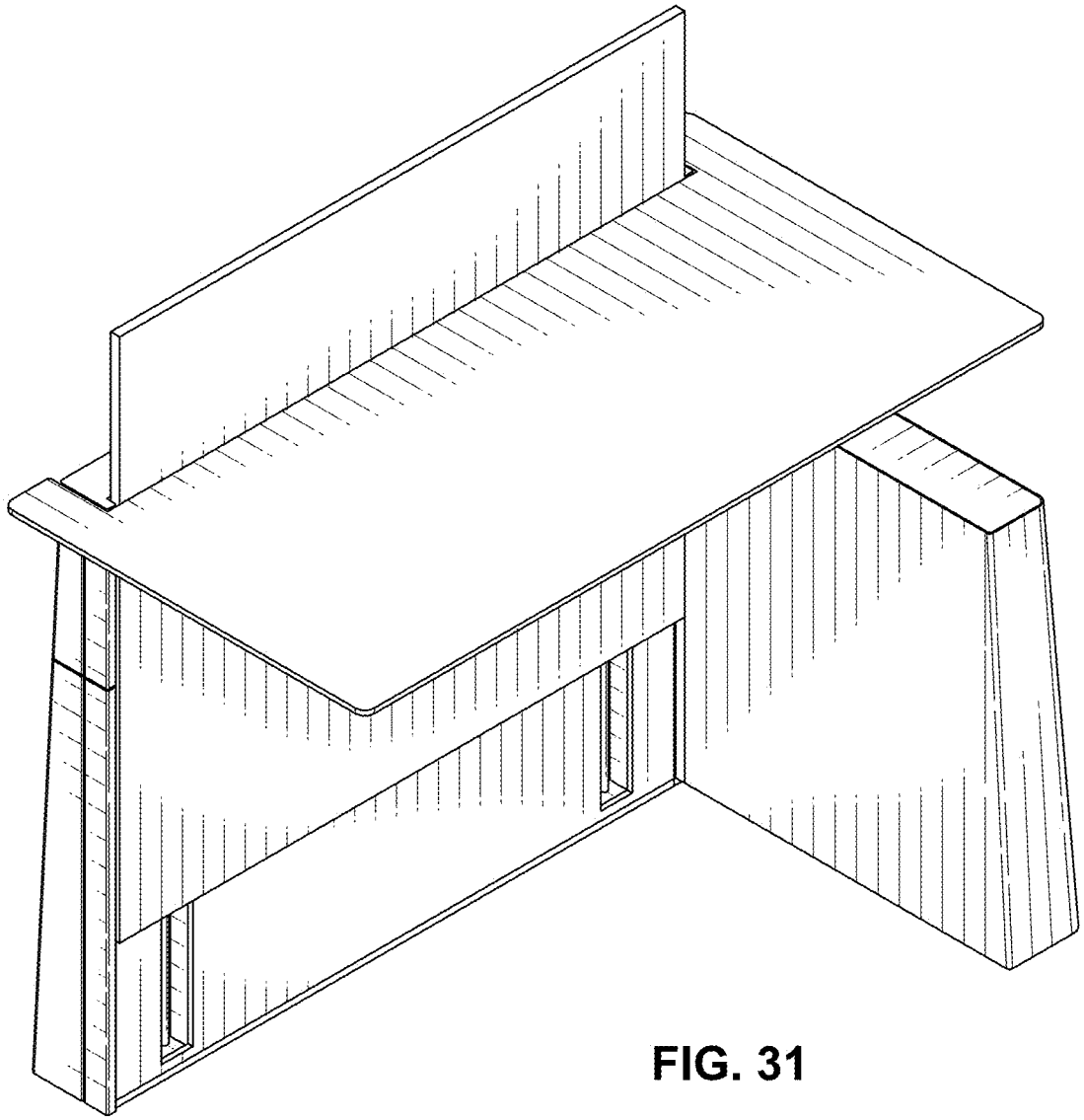
Figure 32:
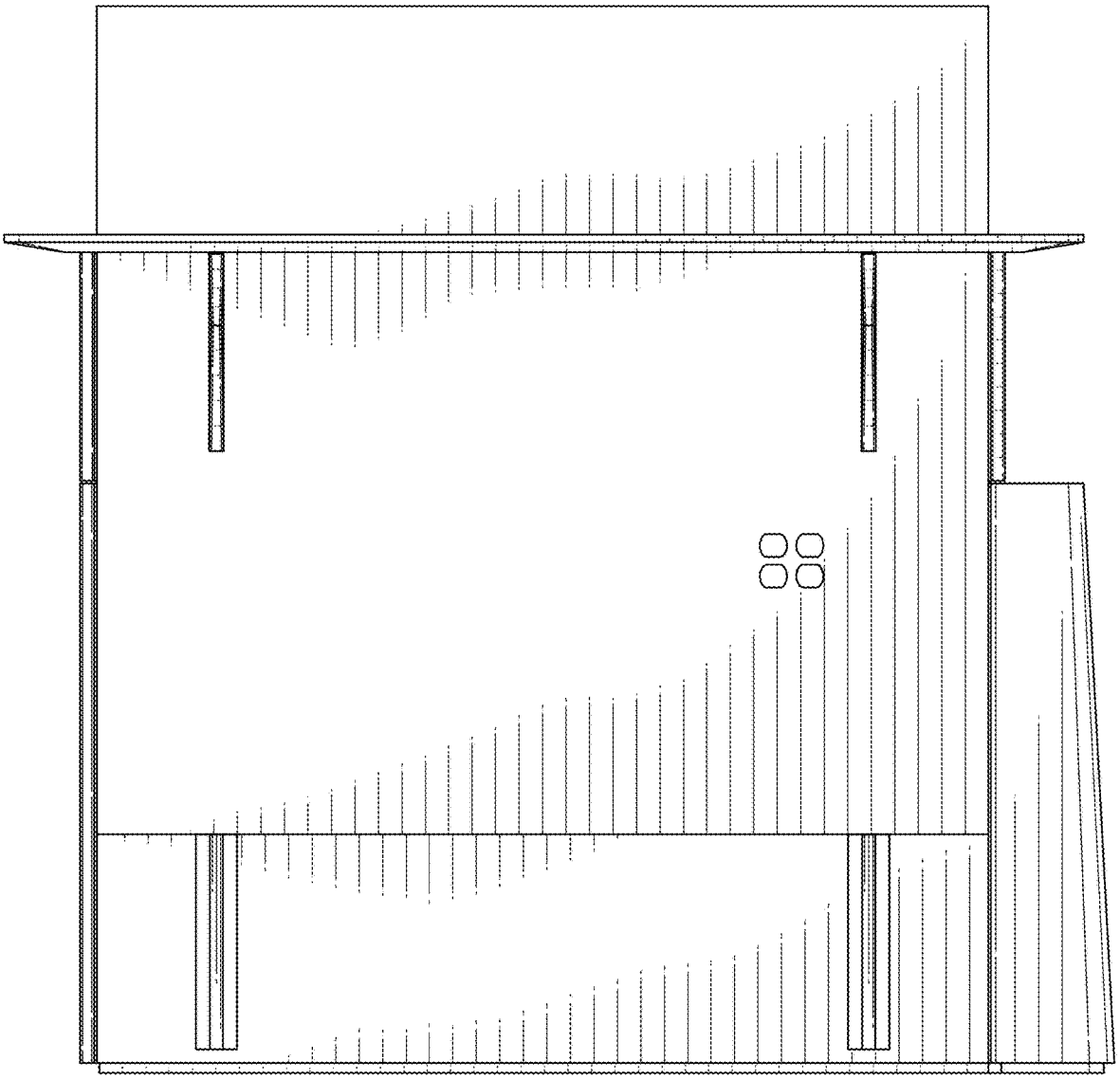
Figure 33:
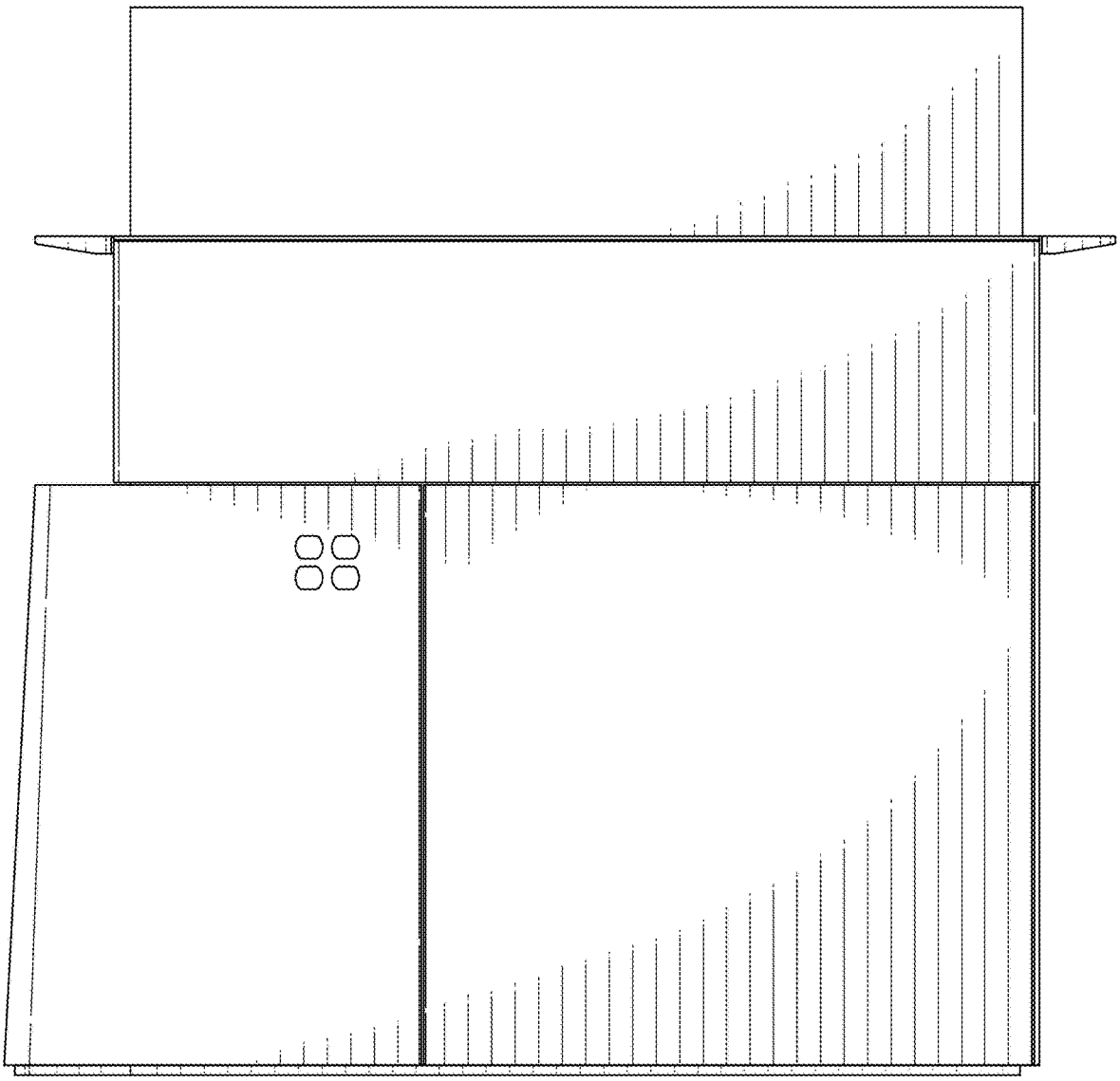
Figure 34:
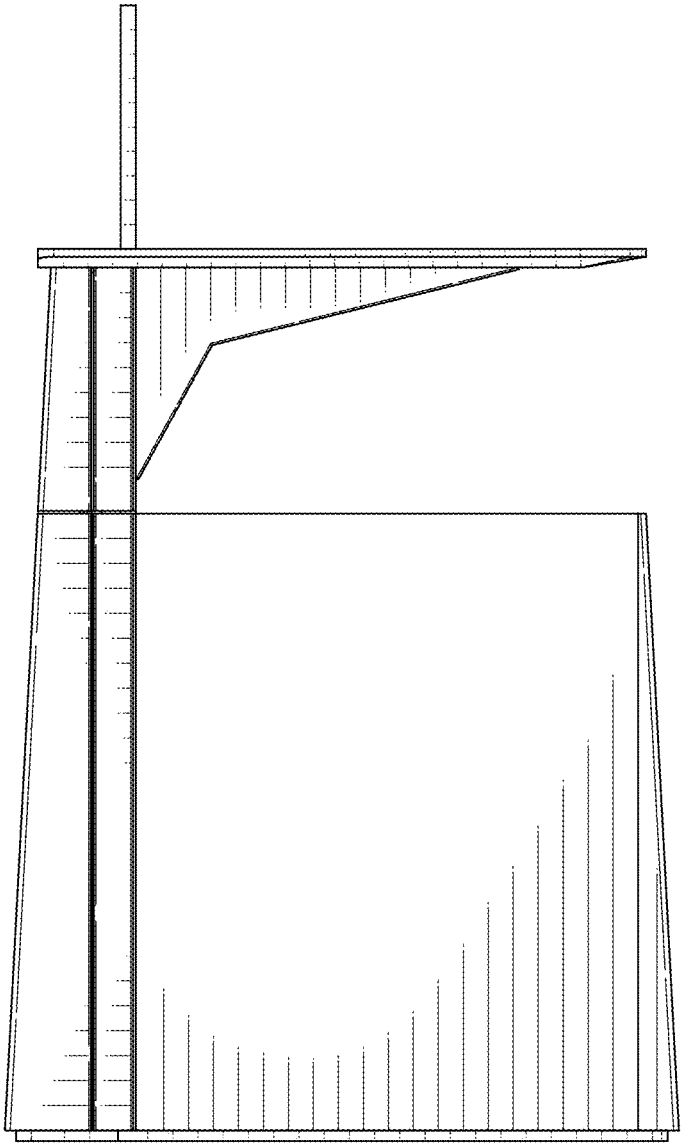
Figure 35:
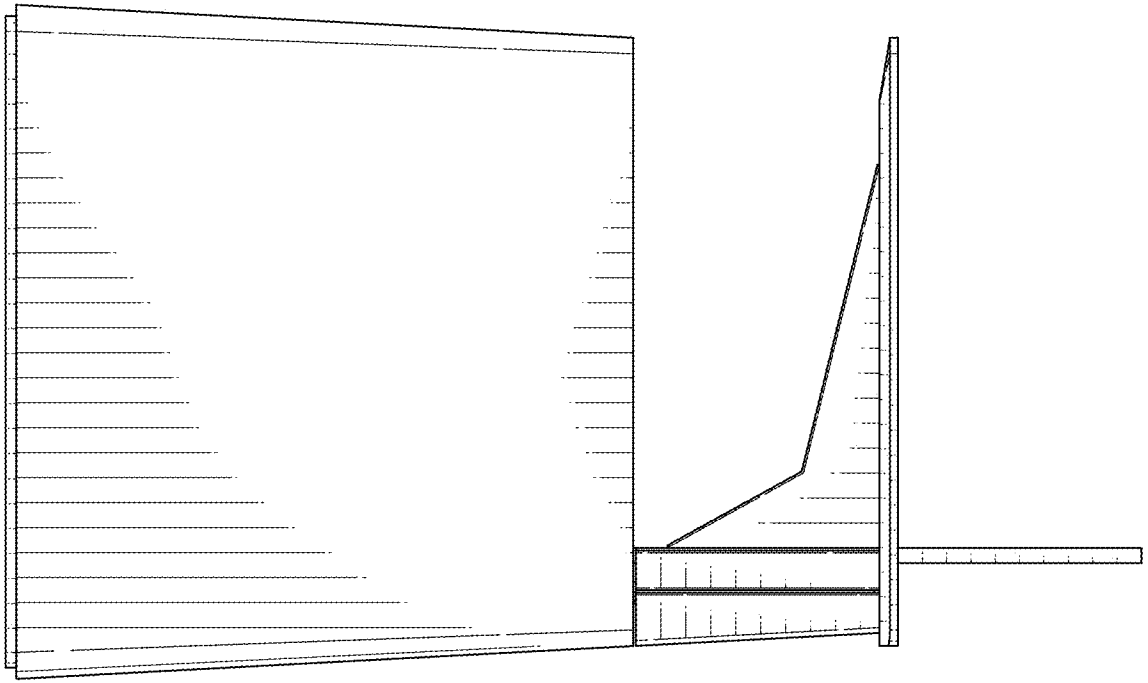
Figure 36:
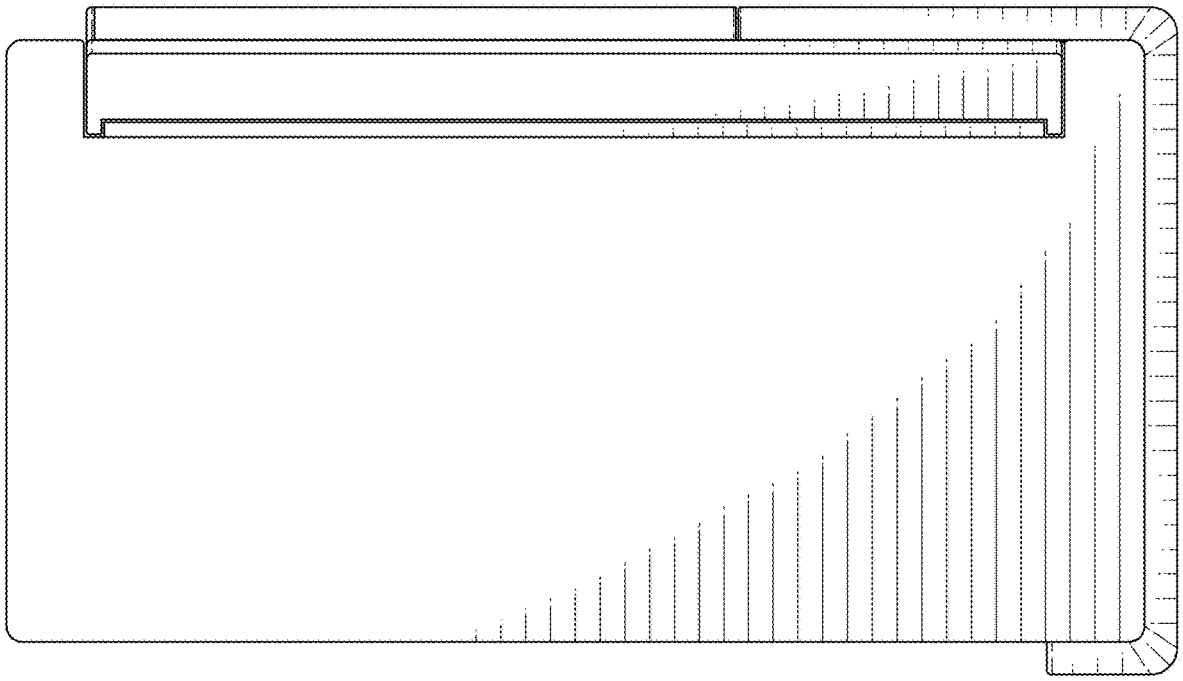
Figure 37:
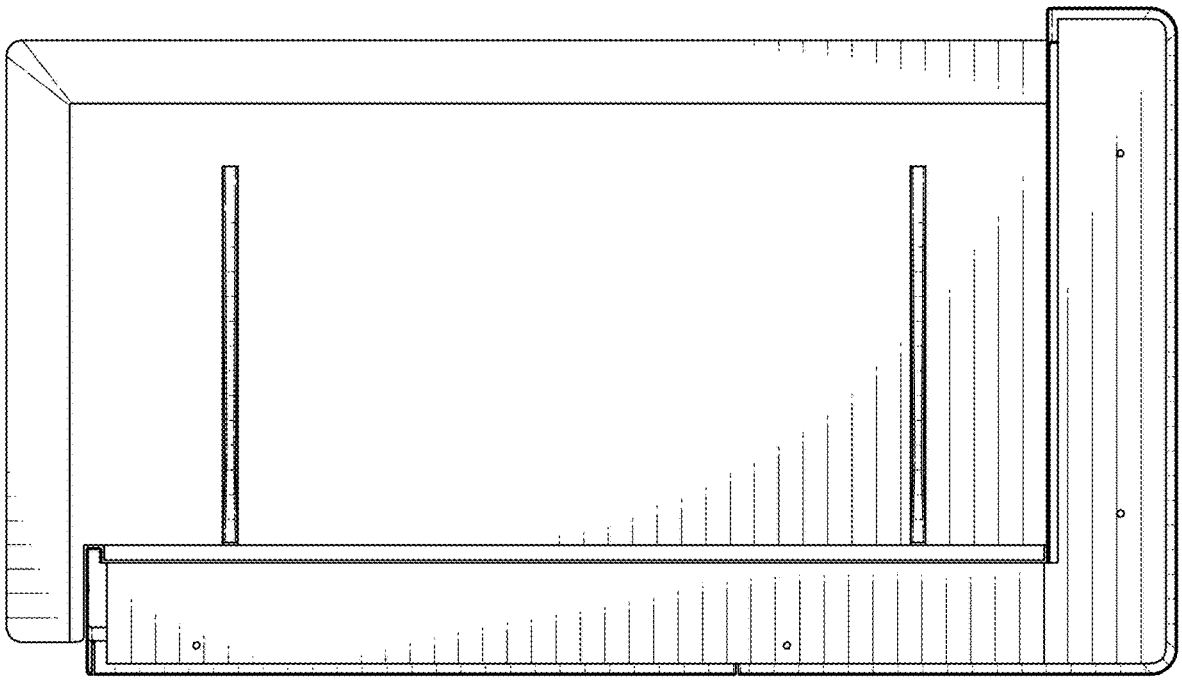

Referring to FIG. 7, various different configurations of variable height desks are shown. For example, the variable height desks 100 and 200 are described above. Variable height desks 100.1 and 200.1 are similar to the above-described variable height desks 100 and 200, respectively, but include taller privacy screens. Variable height desk 100.2 includes an optional fixed height side table. Variable height desk 200.3 includes cabinets and a collaborative top table. Variable height desk 200.4 is similar to the variable height desk 200.3 but includes a smaller collaborative top table. Variable height desk 200.5 includes the collaborative top table and a large conference table. Variable height desk 200.6 includes a small conference table. Variable height desk 200.7 includes a round conference table.

Variable height desk 300.1 includes two of the variable height desks 200 with a large collaborative top table arranged between the two variable height desks 200. Variable height desk 300.2 is similar to the variable height desk 300.1 but includes a smaller collaborative top table. Variable height desk 300.3 is similar to the variable height desk 300.2 but includes an even smaller collaborative top table.

FIGS. 8-23 show different views of a third embodiment of a variable height desk; and FIGS. 24-37 show different views of a fourth embodiment of a variable height desk. The operating mechanisms and features of the variable height desks shown in FIGS. 8-37 are the same as or substantially similar to those discussed above with respect to the other embodiments.

Although the present invention has been described with reference to the example embodiments, those skilled in the art will recognize that various changes and modifications to the described embodiments may be performed, all without departing from the spirit and scope of the present invention. Furthermore, those skilled in the various arts will recognize that the present invention described herein will suggest solutions to other tasks and adaptations for other applications. It is the applicant's intention to cover all such uses of the present invention and those changes and modifications which could be made to the example embodiments of the present invention herein chosen for the purpose of disclosure, all without departing from the spirit and scope of the present invention. Thus, the example embodiments of the present invention should be considered in all respects as illustrative and not restrictive, with the spirit and scope of the present invention.

What is claimed is:

1. A variable height desk comprising:
a main support;
a plurality of linear guides mounted to the main support;
a desk mounting panel mounted to and configured to move along the linear guides;
a desk surface mounted to the desk mounting panel; and
an actuator accommodated in the main support and configured to raise and lower the desk mounting panel,
wherein the main support has an L-shape,
wherein the main support comprises a longer length portion and a shorter length portion, and
wherein the actuator is accommodated in the longer length portion of the main support.

2. The variable height desk of claim 1, wherein the actuator is a worm drive actuator.

3. The variable height desk of claim 1, further comprising a cover panel mounted to the main support, the cover panel having an opening therein exposing an end of the actuator.

4. The variable height desk of claim 3, wherein the actuator comprises a mounting block on the exposed end thereof.

5. A variable height desk comprising:
a main support;
a plurality of linear guides mounted to the main support;
a desk mounting panel mounted to and configured to move along the linear guides;
a desk surface mounted to the desk mounting panel;
an actuator accommodated in the main support and configured to raise and lower the desk mounting panel; and
a privacy screen removably coupled to the desk mounting panel and extending above the desk surface.

6. The variable height desk of claim 5, wherein the privacy screen extends below the desk surface.

7. The variable height desk of claim 6, wherein the privacy screen comprises an extended side portion, the privacy screen and the extended side portion together forming an L-shape.

8. A variable height desk comprising:
a main support;
a plurality of linear guides mounted to the main support, a first group of the linear guides mounted to a first side of the main support, a second group of the linear guides mounted to a second side of the main support;
a first desk mounting panel mounted to and configured to move along the first group of the linear guides;
a second desk mounting panel mounted to and configured to move along the second group of the linear guides;
a first desk surface mounted to the first desk mounting panel;
a second desk surface mounted to the second desk mounting panel; and a plurality of actuators accommodated in the main support, a first one of the actuators being configured to raise and lower the first desk mounting panel, a second one of the actuators being configured to raise and lower the second desk mounting panel.

9. The variable height desk of claim 8, wherein the actuators are arranged adjacent each other along a line perpendicular to a moving direction of the actuators.

10. The variable height desk of claim 9, wherein each of the first and second desk mounting panels has a plurality of groups of mounting openings, a first group of the mounting openings of each of the first and second desk mounting panels being configured for connection to the first one of the actuators, and a second group of the mounting openings of each of the first and second desk mounting panels being configured for connection to the second one of the actuators.

11. The variable height desk of claim 10, wherein the first and second ones of the actuators are configured to raise and lower the first and second desk mounting panels independently from each other.

12. The variable height desk of claim 8, wherein the main support has a T-shape.

13. The variable height desk of claim 8, further comprising a privacy screen coupled between the first desk mounting surface and the first desk surface.

14. The variable height desk of claim 13, wherein the privacy screen comprises a privacy screen mounting rail that is configured to be coupled to an upper edge of the first desk mounting panel.

15. The variable height desk of claim 14, wherein the upper edge of the first desk mounting panel is beveled, wherein a lower edge of the privacy screen mounting rail is beveled, and wherein the beveled upper edge of the first desk mounting panel and the beveled lower edge of the privacy screen mounting rail are configured to be fitted to each other.

16. The variable height desk of claim 15, wherein the privacy screen is mounted to the first desk mounting panel by a friction cleat connection.

17. The variable height desk of claim 15, further comprising a plurality of linear bearings mounted to the first desk mounting panel, the linear bearings being connected to ones of the first group of the linear guides.

18. The variable height desk of claim 17, wherein the linear bearings are track rollers.

* * * * *